US011749190B2

(12) United States Patent
Lee et al.

(10) Patent No.: US 11,749,190 B2
(45) Date of Patent: Sep. 5, 2023

(54) ELECTRONIC DEVICE AND DRIVING METHOD OF ELECTRONIC DEVICE

(71) Applicant: SAMSUNG DISPLAY CO., LTD., Yongin-si (KR)

(72) Inventors: Eunjung Lee, Yongin-si (KR); Youra Kim, Seoul (KR); Hyosun Kim, Seongnam-si (KR); Hyungsuk Hwang, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 18/045,853

(22) Filed: Oct. 12, 2022

(65) Prior Publication Data

US 2023/0162672 A1 May 25, 2023

(30) Foreign Application Priority Data

Nov. 22, 2021 (KR) ..... 10-2021-0161658

(51) Int. Cl.
*G09G 3/32* (2016.01)
*G09G 3/3225* (2016.01)

(52) U.S. Cl.
CPC ..... *G09G 3/3225* (2013.01); *G09G 3/32* (2013.01); *G09G 2320/0247* (2013.01); *G09G 2320/0613* (2013.01); *G09G 2320/103* (2013.01); *G09G 2330/021* (2013.01); *G09G 2360/145* (2013.01); *G09G 2360/16* (2013.01)

(58) Field of Classification Search
CPC ..... G09G 3/32; G09G 3/3225; G09G 2320/0247; G09G 2320/0613; G09G 2320/103; G09G 2330/021; G09G 2360/145; G09G 2360/16
See application file for complete search history.

(56) References Cited

U.S. PATENT DOCUMENTS

| | | | | |
|---|---|---|---|---|
| 9,530,380 | B2 | 12/2016 | Jang et al. | |
| 10,770,001 | B2 | 9/2020 | Park et al. | |
| 11,468,833 | B2 * | 10/2022 | Lee | G09G 3/20 |
| 2014/0313236 | A1 * | 10/2014 | Jang | G09G 5/02 345/204 |
| 2021/0223096 | A1 | 7/2021 | Cho et al. | |

(Continued)

FOREIGN PATENT DOCUMENTS

| | | |
|---|---|---|
| KR | 10-2020-0038385 | 4/2020 |
| KR | 10-2021-0094701 | 7/2021 |

*Primary Examiner* — Gene W Lee
(74) *Attorney, Agent, or Firm* — F. Chau & Associates, LLC

(57) ABSTRACT

An electronic device includes a display panel, a data driving circuit, a scan driving circuit, and a signal control circuit that receives input data. The signal control circuit includes a histogram check unit that divides data of one frame among the input data into a plurality of regions based on a gray scale and calculates a distribution of the data based on the plurality of regions, a gray check unit that calculates the number of major grayscales having data of a specific number or more among the input data, an optical waveform analysis unit that generates a signal calculated based on an optical waveform of the plurality of pixels, and a frequency selection unit that selects a driving frequency of the display panel based on the distribution of the data, the number of the major grayscales, and the signal.

20 Claims, 19 Drawing Sheets

(56) References Cited

U.S. PATENT DOCUMENTS

| | | | | |
|---|---|---|---|---|
| 2022/0114956 | A1* | 4/2022 | Lee | G09G 5/003 |
| 2023/0020872 | A1* | 1/2023 | Lee | G09G 3/3225 |
| 2023/0065185 | A1* | 3/2023 | Lee | G09G 3/3266 |

* cited by examiner

ELECTRONIC DEVICE AND DRIVING METHOD OF ELECTRONIC DEVICE

CROSS-REFERENCE TO RELATED APPLICATIONS

This application claims priority under 35 U.S.C. § 119 to Korean Patent Application No. 10-2021-0161658, filed on Nov. 22, 2021 in the Korean Intellectual Property Office, the disclosure of which is incorporated by reference herein in its entirety.

TECHNICAL FIELD

Embodiments of the present disclosure relate to an electronic device capable of increasing display quality, and a method of driving the electronic device.

DISCUSSION OF RELATED ART

Various display devices used in electronic devices such as televisions, mobile phones, tablet computers, navigation systems, game consoles, etc. are currently being developed. In particular, since portable electronic devices operate on batteries, various efforts are being made to reduce power consumption of display devices used in portable electronic devices.

SUMMARY

Embodiments of the present disclosure provide an electronic device capable of increasing display quality, and a method of driving the electronic device.

According to an embodiment of the present disclosure, an electronic device includes a display panel including a plurality of scan lines, a plurality of data lines, and a plurality of pixels, and that displays an image, a data driving circuit, a scan driving circuit, and a signal control circuit that receives input data and controls the display panel, the data driving circuit, and the scan driving circuit. The signal control circuit includes a histogram check unit that divides data of one frame among the input data into a plurality of regions based on a gray scale and calculates a distribution of the data based on the plurality of regions, a gray check unit that calculates the number of major grayscales having data of a specific number or more among the input data, an optical waveform analysis unit that generates a signal calculated based on an optical waveform of the plurality of pixels, and a frequency selection unit that selects a driving frequency of the display panel based on the distribution of the data, the number of the major grayscales, and the signal.

According to an embodiment, the display panel may further include a photodiode disposed adjacent to the plurality of pixels.

According to an embodiment, the optical waveform analysis unit may calculate the signal based on the optical waveform measured by the photodiode.

According to an embodiment, an active region and a peripheral region disposed adjacent to the active region may be defined in the display panel, and the photodiode may be disposed in the peripheral region.

According to an embodiment, when viewed in a plan view, the photodiode does not overlap the plurality of pixels.

According to an embodiment, the electronic device may further include a memory including a lookup table including information of the optical waveform depending on the display panel, and the optical waveform analysis unit may generate the signal based on the lookup table.

According to an embodiment, the histogram check unit may determine a type of the image based on the distribution of the data, and the type of the image may include a moving image, a still image, and a text screen.

According to an embodiment, the gray check unit may determine the type of the image based on the number of the grayscales.

According to an embodiment, the plurality of regions may include a low grayscale region, a middle grayscale region, and a high grayscale region, and the histogram check unit may determine the type of the image as the text screen when the data are included in the low grayscale region and the high grayscale region by a specific ratio or more.

According to an embodiment, the signal control circuit may further include a signal analysis unit that converts the signal into a frequency domain.

According to an embodiment, the signal control circuit may further include a sensitivity control unit including a time-to-sensitivity function, and the frequency selection unit may calculate the driving frequency based on the time-to-sensitivity function.

According to an embodiment, the signal control circuit may further include a register selection unit that selects a register value depending on the selected driving frequency and outputs a data signal based on the register value, and the display panel may be driven based on the data signal.

According to an embodiment of the present disclosure, a method of driving an electronic device includes receiving input data by a signal control circuit that controls a driving frequency of a display panel, dividing data of one frame among the input data into a plurality of regions based on a gray scale and calculating a distribution of the data based on the plurality of regions, calculating the number of major grayscales having data of a specific number or more among the input data, generating a signal calculated based on an optical waveform of the display panel, and calculating the driving frequency based on the distribution of the data, the number of the major grayscales, and the signal.

According to an embodiment, the display panel may include a plurality of pixels and a photodiode disposed adjacent to the plurality of pixels, and generating the signal may include receiving the optical waveform from the photodiode.

According to an embodiment, generating the signal may include generating the signal based on a lookup table including information of the optical waveform.

According to an embodiment, the display panel may display an image, and calculating the distribution of the data may include determining a type of the image based on the distribution.

According to an embodiment, calculating the number of major grayscales may include determining the type of the image based on the number.

According to an embodiment, the method of driving the electronic device may further include converting the signal into a frequency domain.

According to an embodiment, calculating the driving frequency may include receiving a time-to-sensitivity function, and the driving frequency may be calculated based on the time-to-sensitivity function.

According to an embodiment, the method of driving the electronic device may further include selecting a register value depending on the driving frequency and outputting a data signal based on the register value.

BRIEF DESCRIPTION OF THE DRAWINGS

The above and other objects and features of the present disclosure will become more apparent by describing in detail embodiments thereof with reference to the accompanying drawings.

DETAILED DESCRIPTION

Figure 1:
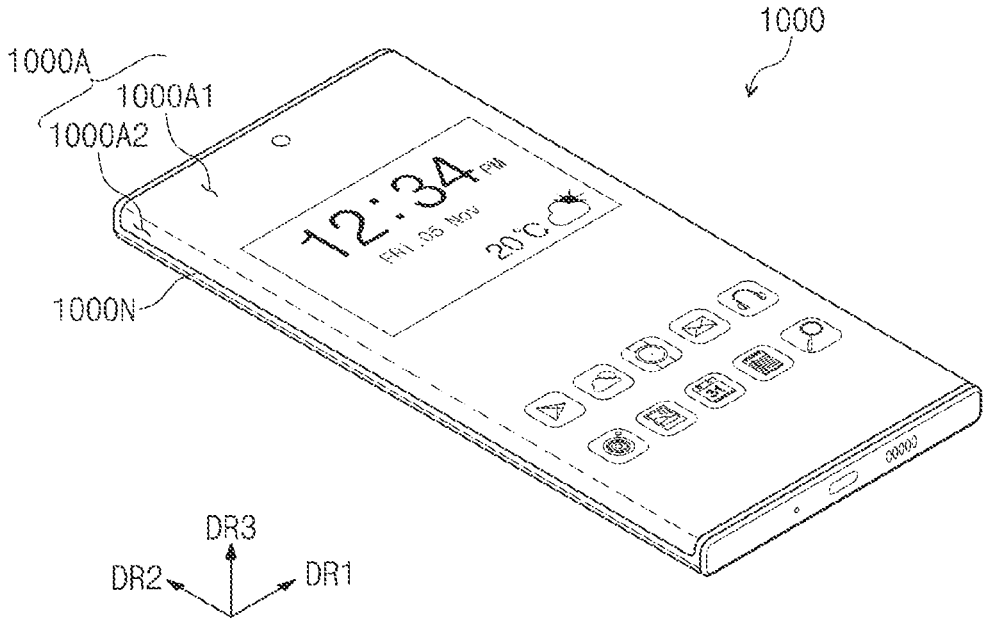
FIG. 1 is a perspective view of an electronic device according to an embodiment of the present disclosure.

Embodiments of the present disclosure will be described more fully hereinafter with reference to the accompanying drawings. Like reference numerals may refer to like elements throughout the accompanying drawings.

It will be understood that when a component such as a film, a region, a layer, or an element, is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present. It will also be understood that when a component is referred to as "covering" another component, it can be the only component covering the other component, or one or more intervening components may also be covering the other component. Other words used to describe the relationships between components should be interpreted in a like fashion.

The terms "first", "second", etc. are used to describe various components, but the components are not limited by the terms. The terms are used only to differentiate one component from another component. For example, a first component may be named as a second component, and vice versa, without departing from the spirit or scope of the present disclosure. A singular form, unless otherwise stated, includes a plural form.

Spatially relative terms, such as "beneath", "below", "lower", "under", "above", "upper", etc., may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below.

It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

Herein, when two or more elements or values are described as being substantially the same as or about equal to each other, it is to be understood that the elements or values are identical to each other, the elements or values are equal to each other within a measurement error, or if measurably unequal, are close enough in value to be functionally equal to each other as would be understood by a person having ordinary skill in the art. For example, the term "about" as used herein is inclusive of the stated value and means within an acceptable range of deviation for the particular value as determined by one of ordinary skill in the art, considering the measurement in question and the error associated with measurement of the particular quantity (e.g., the limitations of the measurement system). For example, "about" may mean within one or more standard deviations as understood by one of the ordinary skill in the art. Further, it is to be understood that while parameters may be described herein as having "about" a certain value, according to embodiments, the parameter may be exactly the certain value or approximately the certain value within a measurement error as would be understood by a person having ordinary skill in the art. Other uses of these terms and similar terms to describe the relationships between components should be interpreted in a like fashion.

It will be further understood that when two components or directions are described as extending substantially parallel or perpendicular to each other, the two components or directions extend exactly parallel or perpendicular to each other, or extend approximately parallel or perpendicular to each other within a measurement error as would be understood by a person having ordinary skill in the art.

FIG. 1 is a perspective view of an electronic device according to an embodiment of the present disclosure.

Referring to FIG. 1, the electronic device 1000 may be a large size electronic device such as, for example, a television, a monitor, or an outdoor billboard. In addition, the electronic device 1000 may be, for example, a small size or a medium size electronic devices such as, for example, a personal computer, a notebook computer, a personal digital terminal, an automotive navigation system, a game console, a smartphone, a tablet, or a camera. However, embodiments of the present disclosure are not limited thereto. FIG. 1 illustrates an example in which the electronic device 1000 is a cellular phone.

An active region 1000A and a peripheral region 1000N may be defined in the electronic device 1000. The active region 1000A may display an image. In the active region 1000A, a first display surface 1000A1 substantially parallel to a surface defined by a first direction DR1 and a second direction DR2 intersecting the first direction DR1 may be defined, and a second display surface 1000A2 extending from the first display surface 1000A1 may be defined.

The second display surface 1000A2 may be provided by being bent from one side of the first display surface 1000A1. Also, a plurality of second display surfaces 1000A2 may be provided. In this case, the second display surfaces 1000A2 may be provided by being bent from at least two sides of the first display surface 1000A1. One first display surface 1000A1 and one or more and four or less second display surfaces 1000A2 may be defined in the active region 1000A. However, the shape of the active region 1000A is not limited thereto. For example, according to embodiments, only the first display surface 1000A1 may be defined in the active region 1000A.

The peripheral region 1000N may be adjacent to the active region 1000A. The peripheral region 1000N may also be referred to as a bezel region.

The thickness direction of the electronic device 1000 may be substantially parallel to a third direction DR3 crossing the first direction DR1 and the second direction DR2. Accordingly, front surfaces (or top surfaces) and rear surfaces (or bottom surfaces) of members constituting the electronic device 1000 may be defined based on the third direction DR3.

Figure 2A:
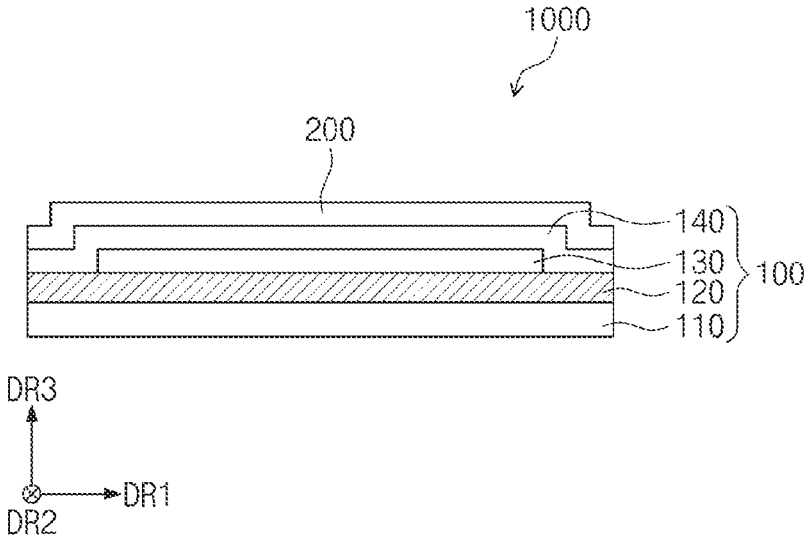
FIG. 2A is a cross-sectional view of an electronic device according to an embodiment of the present disclosure.

FIG. 2A is a cross-sectional view of an electronic device according to an embodiment of the present disclosure.

Referring to FIG. 2A, the electronic device 1000 may include a display panel 100 and a sensor layer 200.

The display panel 100 may be a component that generates an image. The display panel 100 may be, for example, a light emitting display panel. For example, the display panel 100 may be an organic light emitting display panel, a quantum dot display panel, a micro LED display panel, or a nano LED display panel. The display panel 100 may include a base layer 110, a circuit layer 120, a light emitting element layer 130, and an encapsulation layer 140.

The base layer 110 may be a member that provides a base surface on which the circuit layer 120 is disposed. The base layer 110 may be, for example, a glass substrate, a metal substrate, or a polymer substrate. However, embodiments of the present disclosure are not limited thereto. For example, according to embodiments, the base layer 110 may be an inorganic layer, an organic layer, or a composite material layer.

The base layer 110 may have a multi-layered structure. For example, the base layer 110 may include a first synthetic resin layer, a silicon oxide (SiOx) layer disposed on the first synthetic resin layer, an amorphous silicon (a-Si) layer disposed on the silicon oxide layer, and a second synthetic resin layer disposed on the amorphous silicon layer. The silicon oxide layer and the amorphous silicon layer may be referred to as a 'base barrier layer'.

Each of the first and second synthetic resin layers may include polyimide-based resin. Also, each of the first and second synthetic resin layers may include at least one of, for example, acrylate-based resin, methacrylate-based resin, polyisoprene-based resin, vinyl-based resin, epoxy-based resin, urethane-based resin, cellulose-based resin, siloxane-based resin, polyamide-based resin, and perylene-based resin. The wording "~~-based resin" in the specification indicates that "~~-based resin" includes a functional group of "~~".

The circuit layer 120 may be disposed on the base layer 110. The circuit layer 120 may include, for example, an insulating layer, a semiconductor pattern, a conductive pattern, and a signal line. An insulating layer, a semiconductor layer, and a conductive layer may be formed on the base layer 110 through a coating or deposition process, and the insulating layer, the semiconductor layer, and the conductive layer may then be selectively patterned through a plurality of photolithography processes. Thereafter, the semiconductor pattern, the conductive pattern, and the signal line included in the circuit layer 120 may be formed.

The light emitting element layer 130 may be disposed on the circuit layer 120. The light emitting element layer 130 may include a light emitting element. For example, the light emitting element layer 130 may include an organic light emitting material, a quantum dot, a quantum rod, a micro-LED, or a nano-LED.

The encapsulation layer 140 may be disposed on the light emitting element layer 130. The encapsulation layer 140 may protect the light emitting element layer 130 from foreign substances such as, for example, moisture, oxygen, and dust particles.

The sensor layer 200 may be disposed on the display panel 100. The sensor layer 200 may sense an external input applied to the sensor layer 200 from outside of the electronic device 1000.

The sensor layer 200 may be formed on the display panel 100 through a successive process. In this case, the sensor layer 200 may be expressed as being directly disposed on the display panel 100. The wording "~being directly disposed~" indicates that a third component is not intervened (disposed) between the sensor layer 200 and the display panel 100. For example, an additional member such as, for example, an adhesive member, is not interposed between the sensor layer 200 and the display panel 100 according to embodiments. Alternatively, the sensor layer 200 may be bonded to the display panel 100 through an adhesive member according to embodiments. The adhesive member may include a typical adhesive or a sticking agent.

Figure 2B:
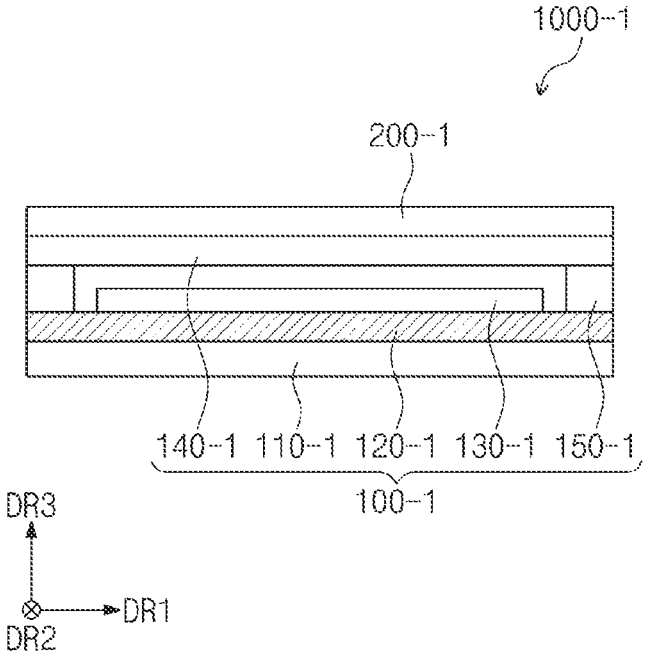
FIG. 2B is a cross-sectional view of an electronic device according to an embodiment of the present disclosure.

FIG. 2B is a cross-sectional view of an electronic device according to an embodiment of the present disclosure.

Referring to FIG. 2B, an electronic device 1000-1 may include a display panel 100-1 and a sensor layer 200-1. The display panel 100-1 may include a base substrate 110-1, a circuit layer 120-1, a light emitting element layer 130-1, an encapsulation substrate 140-1, and a coupling member 150-1.

Each of the base substrate 110-1 and the encapsulation substrate 140-1 may be, for example, a glass substrate, a metal substrate, a polymer substrate, etc., but is not particularly limited thereto.

The coupling member 150-1 may be interposed between the base substrate 110-1 and the encapsulation substrate 140-1. The coupling member 150-1 may couple the encapsulation substrate 140-1 to the base substrate 110-1 or the circuit layer 120-1. The coupling member 150-1 may include an inorganic material or an organic material. For example, the inorganic material may include a frit seal, and the organic material may include a photo-curable resin or a photo-plastic resin. However, a material of the coupling member 150-1 is not limited to the above example.

The sensor layer 200-1 may be directly disposed on the encapsulation substrate 140-1. The wording "~being directly disposed~" indicates that a third component is not intervened (disposed) between the sensor layer 200-1 and the encapsulation substrate 140-1. For example, an additional member such as, for example, an adhesive member, is not interposed between the sensor layer 200-1 and the display panel 100-1 according to embodiments. However, embodiments of the present disclosure are not limited thereto. For example, according to embodiments, an adhesive layer may be further disposed between the sensor layer 200-1 and the encapsulation substrate 140-1.

Figure 3:
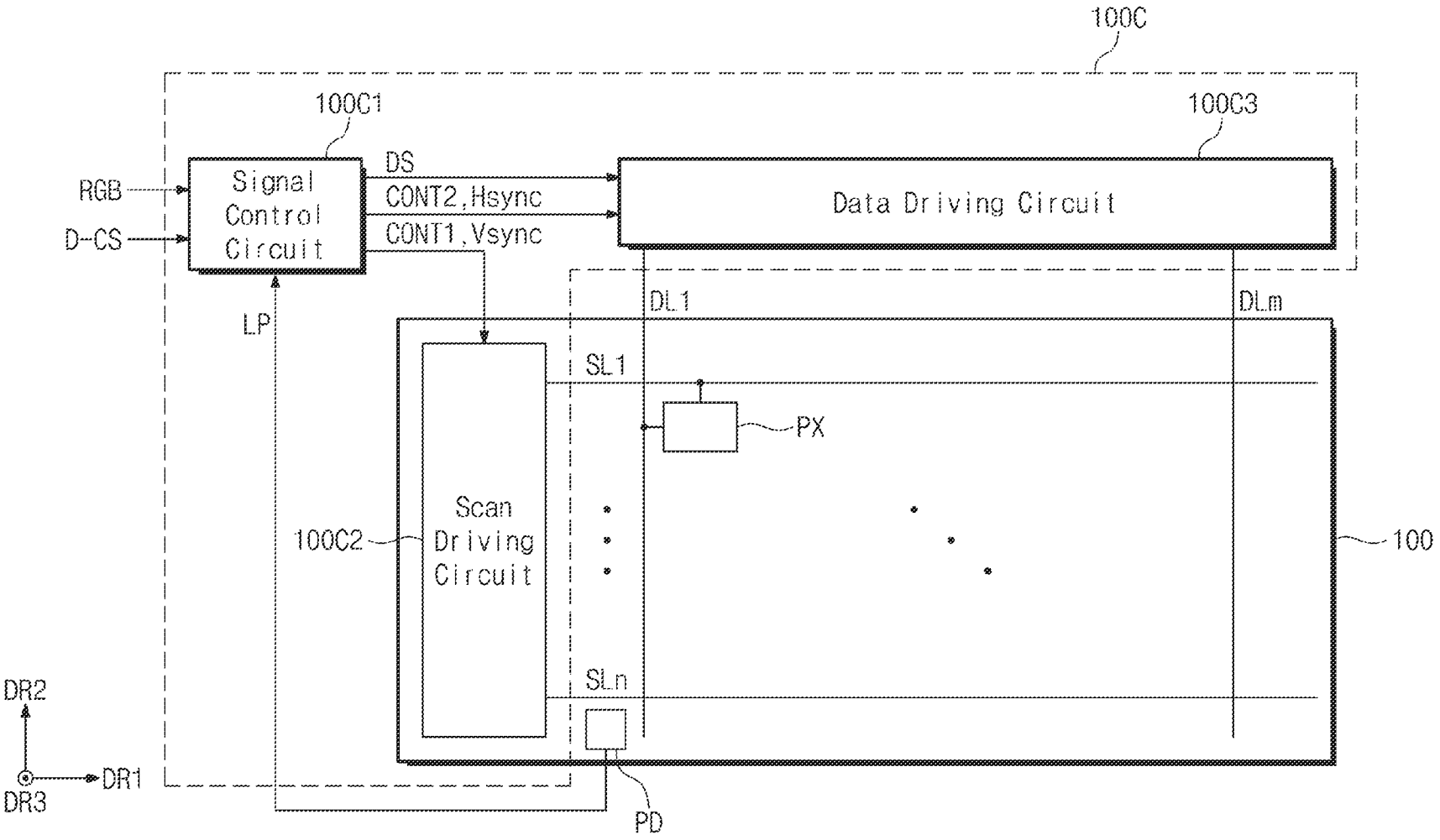
FIG. 3 is a block diagram of a display panel and a display control unit, according to an embodiment of the present disclosure.

FIG. 3 is a block diagram of a display panel and a display control unit according to an embodiment of the present disclosure.

Referring to FIG. 3, the display panel 100 may include a plurality of scan lines SL1 to SLn, a plurality of data lines DL1 to DLm, and a plurality of pixels PX, in which each of m and is a positive integer. Each of the plurality of pixels PX may be connected to a corresponding data line of the plurality of data lines DL1 to DLm and may be connected to a corresponding scan line of the plurality of scan lines SL1 to SLn. In an embodiment of the present disclosure, the display panel 100 may further include light emission control lines, and a display control unit 100C may further include a light emission driving circuit that provides control signals to the light emission control lines. This will be described in further detail below, and the configuration of the display panel 100 is not particularly limited.

The display panel 100 may include a photodiode PD. The photodiode PD may be disposed adjacent to one of the plurality of pixels PX. The photodiode PD may form a CMOS image sensor or a CCD camera, but is not limited thereto. The photodiode PD may generate an output signal corresponding to the light received from one of the plurality of pixels PX. The output signal generated by the photodiode PD may include an optical waveform LP. The photodiode PD may transmit the optical waveform LP to a signal control circuit 100C1.

The display control unit 100C may include a signal control circuit 100C1, a scan driving circuit 100C2, and a data driving circuit 100C3.

The signal control circuit 100C1 may receive input data RGB and a control signal D-CS from an external control unit. The external control unit may include a graphic processing unit. The control signal D-CS may include various signals. For example, the control signal D-CS may include an input vertical synchronization signal, an input horizontal synchronization signal, a main clock, and a data enable signal.

The signal control circuit 100C1 may generate a first control signal CONT1 and a vertical synchronization signal Vsync, based on the control signal D-CS, and may output the first control signal CONT1 and the vertical synchronization signal Vsync to the scan driving circuit 100C2. The vertical synchronization signal Vsync may be included in the first control signal CONT1.

The signal control circuit 100C1 may generate a second control signal CONT2 and a horizontal synchronization signal Hsync, based on the control signal D-CS, and may output the second control signal CONT2 and the horizontal synchronization signal Hsync to the data driving circuit 100C3. The horizontal synchronization signal Hsync may be included in the second control signal CONT2.

Also, the signal control circuit 100C1 may output a data signal DS, which is obtained by processing the input data RGB so as to comply with an operating condition of the display panel 100, to the data driver circuit 100C3. The first control signal CONT1 and the second control signal CONT2 are signals utilized for the operation of the scan driving circuit 100C2 and the data driving circuit 100C3, and are not particularly limited thereto.

The scan driving circuit 100C2 may drive a plurality of scan lines SL1-SLn in response to the first control signal CONT1 and the vertical synchronization signal Vsync. In an embodiment of the present disclosure, the scan driving circuit 100C2 may be formed in the same process as the circuit layer 120 (refer to FIG. 5) in the display panel 100, but embodiments of the present disclosure are not limited thereto. For example, the scan driving circuit 100C2 may be implemented with an integrated circuit (IC) for electrical connection with the display panel 100. The integrated circuit may be directly mounted in a given area of the display panel 100 or may be mounted on a separate printed circuit board (PCB) in a chip on film (COF) manner.

The data driving circuit 100C3 may output gray scale voltages for driving the plurality of data lines DL1 to DLm in response to the second control signal CONT2, the horizontal synchronization signal Hsync, and the data signal DS from the signal control circuit 100C1. The data driving circuit 100C3 may be implemented with an integrated circuit for electrical connection with the display panel 100. The integrated circuit may be directly mounted in a given area of the display panel 100 or may be mounted on a separate printed circuit board in the chip on film manner, but embodiments of the present disclosure are not limited thereto. For example, the data driving circuit 100C3 may be formed in the same process as the circuit layer 120 (refer to FIG. 2A) in the display panel 100.

Figure 4:
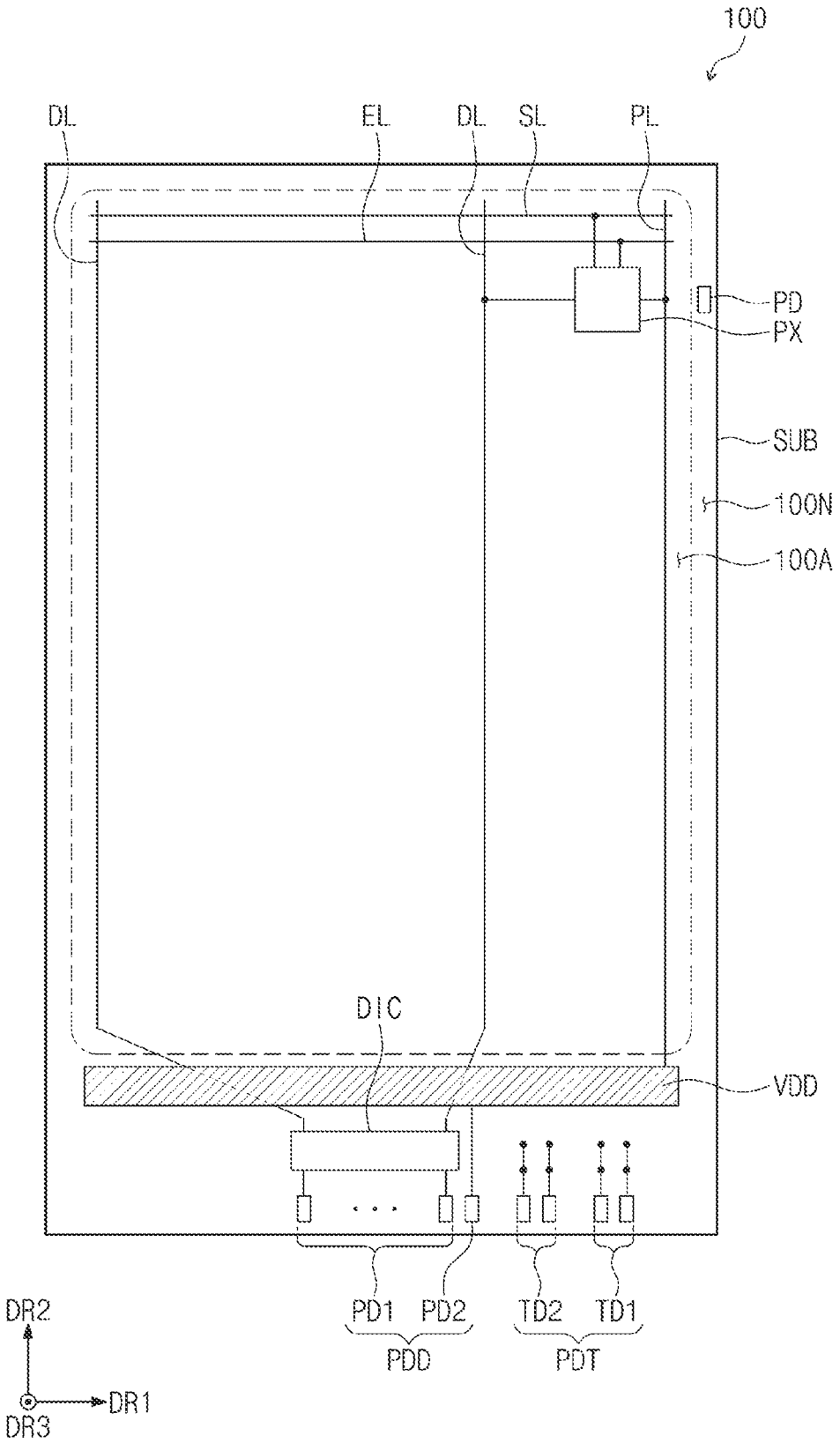
FIG. 4 is a plan view of a display panel, according to an embodiment of the present disclosure.

FIG. 4 is a plan view of a display panel, according to an embodiment of the present disclosure.

In the description of FIG. 4, for convenience of explanation, the same reference numerals are assigned to the same components described with reference to FIG. 3, and a further description of components and technical aspects previously described is omitted.

Referring to FIG. 4, an active region 100A and a peripheral region 100N adjacent to the active region 100A may be defined in the display panel 100. According to embodiments, the active region 100A is a region in which an image is displayed. The plurality of pixels PX may be disposed in the active region 100A. According to embodiments, the peripheral region 100N is a region in which a driving circuit or driving wiring is disposed, and in which an image is not displayed. When viewed in a plan view, the active region 100A may overlap the active region 1000A (refer to FIG. 1) of the electronic device 1000 (refer to FIG. 1), and the peripheral region 100N may overlap the peripheral region 1000N (refer to FIG. 1) of the electronic device 1000 (refer to FIG. 1).

The display panel 100 may include the base layer 110, the plurality of pixels PX, a plurality of signal lines GL, DL, PL, and EL, a power pattern VDD, and a plurality of display pads PDD.

Each of the plurality of pixels PX may display one of primary colors or one of mixed colors. The primary colors may include red, green, or blue. The mixed colors may include various colors such as, for example, white, yellow, cyan, or magenta. However, the color displayed by each of the pixels PX is not limited thereto.

The plurality of signal lines GL, DL, PL, and EL may be disposed on the base layer 110. The plurality of signal lines SL, DL, PL, and EL may be connected to the plurality of pixels PX to transmit electrical signals to the plurality of pixels PX. The plurality of signal lines SL, DL, PL, and EL may include a plurality of scan lines SL, a plurality of data lines DL, a plurality of power lines PL, and a plurality of light emission control lines EL. However, this is only an example, and the configuration of the plurality of signal lines SL, DL, PL, and EL according to embodiments of the present disclosure are not limited thereto. For example, the plurality of signal lines SL, DL, PL, and EL according to an embodiment of the present disclosure may further include an initialization voltage line.

The power pattern VDD may be disposed in the peripheral region 100N. The power pattern VDD may be connected to the plurality of power lines PL. The display panel DP may provide the same power signal to the plurality of pixels PX by including the power pattern VDD.

The plurality of display pads PDD may be disposed in the peripheral region 100N. The plurality of display pads PDD may include a first pad PD1 and a second pad PD2. The first pad PD1 may be one of a plurality of first pads PD1. The plurality of first pads PD1 may be respectively connected to the plurality of data lines DL. The second pad PD2 may be connected to the power pattern VDD to be electrically connected to the plurality of power lines PL. The display panel DP may provide the plurality of pixels PX with electrical signals provided from outside of the display panel 100 through the display pads PDD. According to embodiments, the plurality of display pads PDD may further include pads for receiving other electrical signals in addition to the first pad PD1 and the second pad PD2.

A driving circuit DIC may be mounted in the peripheral region 100N. The driving circuit DIC may be a chip-type timing control circuit. The plurality of data lines DL may be electrically connected to the plurality of first pads PD1 through the driving circuit DIC, respectively. However, this is only an example, and embodiments of the present disclosure are not limited thereto. For example, according to embodiments, the driving circuit DIC may be mounted on a film separate from the display panel DP. In this case, the driving circuit DIC may be electrically connected to the plurality of display pads PDD through the film.

The photodiode PD may be disposed in the peripheral region 100N. In an embodiment, when viewed in a plan view, the photodiode PD does not overlap the plurality of pixels PX.

Figure 5:
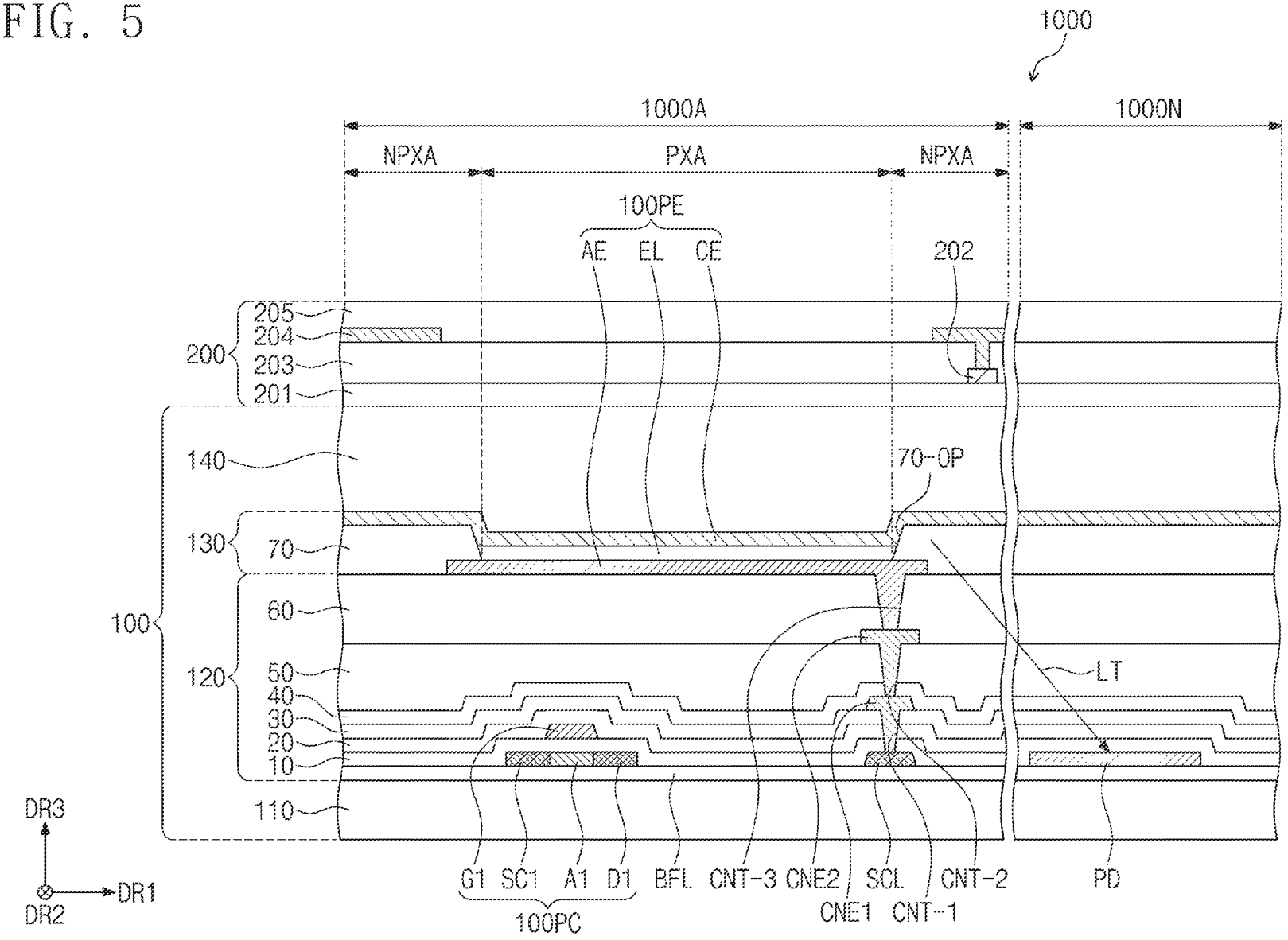
FIG. 5 is a cross-sectional view of an electronic device according to an embodiment of the present disclosure.

FIG. 5 is a cross-sectional view of an electronic device according to an embodiment of the present disclosure.

In the description of FIG. 5, for convenience of explanation, the same reference numerals are assigned to the same components described with reference to FIG. 2A, and a further description of components and technical aspects previously described is omitted.

Referring to FIG. 5, at least one inorganic layer may be formed on an upper surface of the base layer 110. The inorganic layer may include at least one of, for example, aluminum oxide, titanium oxide, silicon oxide, silicon oxynitride, zirconium oxide, and hafnium oxide. The inorganic layer may be formed of multiple layers. The multiple inorganic layers may constitute a barrier layer and/or a buffer layer. In an embodiment, the display panel 100 includes a buffer layer BFL.

The buffer layer BFL may increase a bonding force between the base layer 110 and a semiconductor pattern. The buffer layer BFL may include a silicon oxide layer and a silicon nitride layer, and the silicon oxide layer and the silicon nitride layer may be alternately stacked.

The semiconductor pattern may be disposed on the buffer layer BFL. The semiconductor pattern may include polysilicon. However, embodiments of the present disclosure are not limited thereto. For example, according to embodiments, the semiconductor pattern may include amorphous silicon, low-temperature polycrystalline silicon, or oxide semiconductor.

FIG. 5 only illustrates a portion of the semiconductor pattern for convenience of illustration. It is to be understood that the semiconductor pattern may be further disposed in another region(s). Semiconductor patterns may be arranged across pixels according to a specific rule. An electrical property of the semiconductor pattern may vary depending on whether it is doped. The semiconductor pattern may include a first region having higher conductivity and a second region having lower conductivity. The first region may be doped with an N-type dopant or a P-type dopant. A P-type transistor may include a doping region doped with the P-type dopant, and an N-type transistor may include a doping region doped with the N-type dopant. The second region may be a non-doping region or may be a region doped at a concentration lower than the concentration of the first region.

According to embodiments, a conductivity of the first region is greater than a conductivity of the second region, and the first region may serve as an electrode or a signal line. The second region may correspond to an active (or channel) of a transistor. For example, a portion of the semiconductor pattern may be an active of a transistor, another portion thereof may be a source or a drain of the transistor, and another portion thereof may be a connection electrode or a connection signal line.

Each of pixels may be expressed by an equivalent circuit including 7 transistors, one capacitor, and a light emitting element. However, each of the pixels is not limited thereto, and the equivalent circuit of the pixel may be modified in various forms according to embodiments. One transistor 100PC and one light emitting element 100PE included in the pixel are illustrated in FIG. 5 by way of example.

The transistor 100PC may include a source SC1, an active A1, a drain D1, and a gate G1. The source SC1, the active A1, and the drain D1 may be formed from a semiconductor pattern. The source SC1 and the drain D1 may extend from the active A1 in directions facing away from each other on a cross-section. A portion of a connection signal line SCL formed from the semiconductor pattern is illustrated in FIG. 5. According to embodiments, the connection signal line SCL may be connected to the drain D1 of the transistor 100PC on a plane.

A first insulating layer 10 may be disposed on the buffer layer BFL. The first insulating layer 10 may overlap a plurality of pixels in common and may cover the semiconductor pattern. The first insulating layer 10 may be an inorganic layer and/or an organic layer, and may have a single-layer structure or a multi-layer structure. The first insulating layer 10 may include at least one of, for example, an aluminum oxide, a titanium oxide, a silicon oxide, a silicon oxynitride, a zirconium oxide, and a hafnium oxide. According to an embodiment, the first insulating layer 10 may be a silicon oxide layer having a single-layer. The first insulating layer 10 and an insulating layer of the circuit layer 120, which is described in further detail below, may be an inorganic layer and/or an organic layer, and may have a single-layer structure or a multi-layer structure. The inorganic layer may include at least one of the above-described materials, but is not limited thereto.

The gate G1 is disposed on the first insulating layer 10. The gate G1 may be a portion of a metal pattern. The gate G1 overlaps the active A1. The gate G1 may function as a mask in a process of doping the semiconductor pattern.

A second insulating layer 20 may be disposed on the first insulating layer 10 and may cover the gate G1. The second insulating layer 20 may overlap the pixels in common. The second insulating layer 20 may be an inorganic layer and/or an organic layer, and may have a single-layer or multi-layer structure. The second insulating layer 20 may include at least one of, for example, silicon oxide, silicon nitride, and silicon oxy nitride. In an embodiment, the second insulating layer 20 may have a multi-layer structure including a silicon oxide layer and a silicon nitride layer.

A third insulating layer 30 may be disposed on the second insulating layer 20. The third insulating layer 30 may have a single-layer or multi-layer structure. In an embodiment, the third insulating layer 30 may have a multi-layer structure including a silicon oxide layer and a silicon nitride layer.

A first connection electrode CNE1 may be disposed on the third insulating layer 30. The first connection electrode CNE1 may be connected to the connection signal line SCL through a contact hole CNT-1 formed through the first insulating layer 10, the second insulating layer 20, and the third insulating layer 30.

A fourth insulating layer 40 may be disposed on the third insulating layer 30. The fourth insulating layer 40 may be a single silicon oxide layer. A fifth insulating layer 50 may be disposed on the fourth insulating layer 40. The fifth insulating layer 50 may be an organic layer.

A second connection electrode CNE2 may be disposed on the fifth insulating layer 50. The second connection electrode CNE2 may be connected to the first connection electrode CNE1 through a contact hole CNT-2 penetrating the fourth insulating layer 40 and the fifth insulating layer 50.

A sixth insulating layer 60 may be disposed on the fifth insulating layer 50 and may cover the second connection electrode CNE2. The sixth insulating layer 60 may be an organic layer.

The light emitting element layer 130 may be disposed on the circuit layer 120. The light emitting element layer 130 may include the light emitting element 100PE. For example, the light emitting element layer 130 may include an organic light emitting material, a quantum dot, a quantum rod, a micro-LED, or a nano-LED. Hereinafter, a description will be given under the assumption that the light emitting element 100PE is an organic light emitting element. However, embodiments of the present disclosure are not limited thereto.

The light emitting element 100PE may include a first electrode AE, a light emitting layer EL, and a second electrode CE. The first electrode AE may be disposed on the sixth insulating layer 60. The first electrode AE may be connected to the second connection electrode CNE2 through a contact hole CNT-3 penetrating the sixth insulating layer 60.

A pixel defining layer 70 may be disposed on the sixth insulating layer 60 and may cover a portion of the first electrode AE. An opening 70-OP is defined in the pixel defining layer 70. The opening 70-OP of the pixel defining layer 70 exposes at least a portion of the first electrode AE.

The active region 100A (refer to FIG. 4) may include an emission region PXA and a non-emission region NPXA adjacent to the emission region PXA. The non-emission region NPXA may surround the emission region PXA. In an embodiment, the emission region PXA is defined to correspond to the portion of the first electrode AE, which is exposed by the opening 70-OP.

The light emitting layer EL may be disposed on the first electrode AE. The light emitting layer EL may be disposed in a region corresponding to the opening 70-OP. For example, the light emitting layer EL may be independently formed for respective pixels. In the case where light emitting layers EL are independently formed for respective pixels, each of the light emitting layers EL may emit a light of at least one of a blue color, a red color, and a green color. However, embodiments of the present disclosure are not limited thereto, and the light emitting layer EL may be connected to the pixels in common. In this case, the light emitting layer EL may provide blue light or white light.

The second electrode CE may be disposed on the light emitting layer EL. The second electrode CE may have an integral shape and may be commonly disposed in the plurality of pixels.

According to embodiments, a hole control layer may be interposed between the first electrode AE and the light emitting layer EL. The hole control layer may be disposed in common in the emission region PXA and the non-emission region NPXA. The hole control layer may include a hole transport layer and may further include a hole injection layer. An electron control layer may be interposed between the light emitting layer EL and the second electrode CE. The electron control layer may include an electron transport layer and may further include an electron injection layer. The hole control layer and the electron control layer may be formed, in common, in a plurality of pixels by using an open mask.

The encapsulation layer 140 may be disposed on the light emitting element layer 130. The encapsulation layer 140 may include an inorganic layer, an organic layer, and an inorganic layer sequentially stacked. Layers constituting the encapsulation layer 140 are not limited thereto.

The inorganic layers may protect the light emitting element layer 130 from, for example, moisture and oxygen, and the organic layer may protect the light emitting element layer 130 from a foreign material such as, for example, dust particles. The inorganic layers may include, for example, a silicon nitride layer, a silicon oxynitride layer, a silicon oxide layer, a titanium oxide layer, or an aluminum oxide layer. The organic layer may include, for example, an acrylic-based organic layer.

The sensor layer 200 may be formed on the display panel 100 through a successive process. In this case, the sensor layer 200 may be expressed as being directly disposed on the display panel 100. The wording "~being directly disposed~" indicates that a third component is not intervened (disposed) between the sensor layer 200 and the display panel 100. For example, an additional member such as, for example, an adhesive member, is not interposed between the sensor layer 200 and the display panel 100 according to embodiments. Alternatively, the sensor layer 200 may be bonded to the display panel 100 through an adhesive member according to embodiments. The adhesive member may include a typical adhesive or a sticking agent.

The sensor layer 200 may include a base insulating layer 201, a first conductive layer 202, a sensing insulating layer 203, a second conductive layer 204, and a cover insulating layer 205.

The base insulating layer 201 may be an inorganic layer including at least one of, for example, silicon nitride, silicon oxy nitride, and silicon oxide. Alternatively, the base insulating layer 201 may be an organic layer including, for example, an epoxy resin, an acrylic resin, or an imide-based resin. The base insulating layer 201 may have a single-layer structure or may be a multi-layer structure in which a plurality of layers are stacked along the third direction DR3.

Each of the first conductive layer 202 and the second conductive layer 204 may have a single-layer structure or a multi-layer structure in which a plurality of layers are stacked along the third direction DR3.

A conductive layer of a single-layer structure may include a metal layer or a transparent conductive layer. The metal layer may include, for example, molybdenum, silver, titanium, copper, aluminum, or an alloy thereof. The transparent conductive layer may include a transparent conductive oxide such as, for example, indium tin oxide (ITO), indium zinc oxide (IZO), zinc oxide (ZnO), or indium zinc tin oxide (IZTO), etc. In addition, the transparent conductive layer may include a conductive polymer such as, for example, a PEDOT, a metal nano-wire, a graphene, etc.

A conductive layer in the multi-layer structure may include metal layers. The metal layers may have a three-layer structure of titanium/aluminum/titanium. The conductive layer of the multi-layer structure may include at least one metal layer and at least one transparent conductive layer.

At least one of the sensing insulating layer 203 and the cover insulating layer 205 may include an inorganic film. The inorganic film may include at least one of, for example, aluminum oxide, titanium oxide, silicon oxide, silicon oxynitride, zirconium oxide, and hafnium oxide.

At least one of the sensing insulating layer 203 and the cover insulating layer 205 may include an organic film. The organic film may include at least one of, for example, acrylate-based resin, methacrylate-based resin, polyisoprene-based resin, vinyl-based resin, epoxy-based resin, urethane-based resin, cellulose-based resin, siloxane-based resin, polyimide-based resin, polyamide-based resin, and perylene-based resin.

The photodiode PD may be disposed on the buffer layer BFL. For example, the photodiode PD may be formed on the same layer as the transistor 100PC. However, this is only an example, and the photodiode PD according to embodiments of the present disclosure may be disposed on various layers. For example, the photodiode PD may be disposed between a plurality of layers disposed in the circuit layer 120.

The photodiode PD may receive light LT generated by the light emitting element 100PE. The photodiode PD may generate the optical waveform LP (refer to FIG. 3) based on the received light LT.

Figure 6:
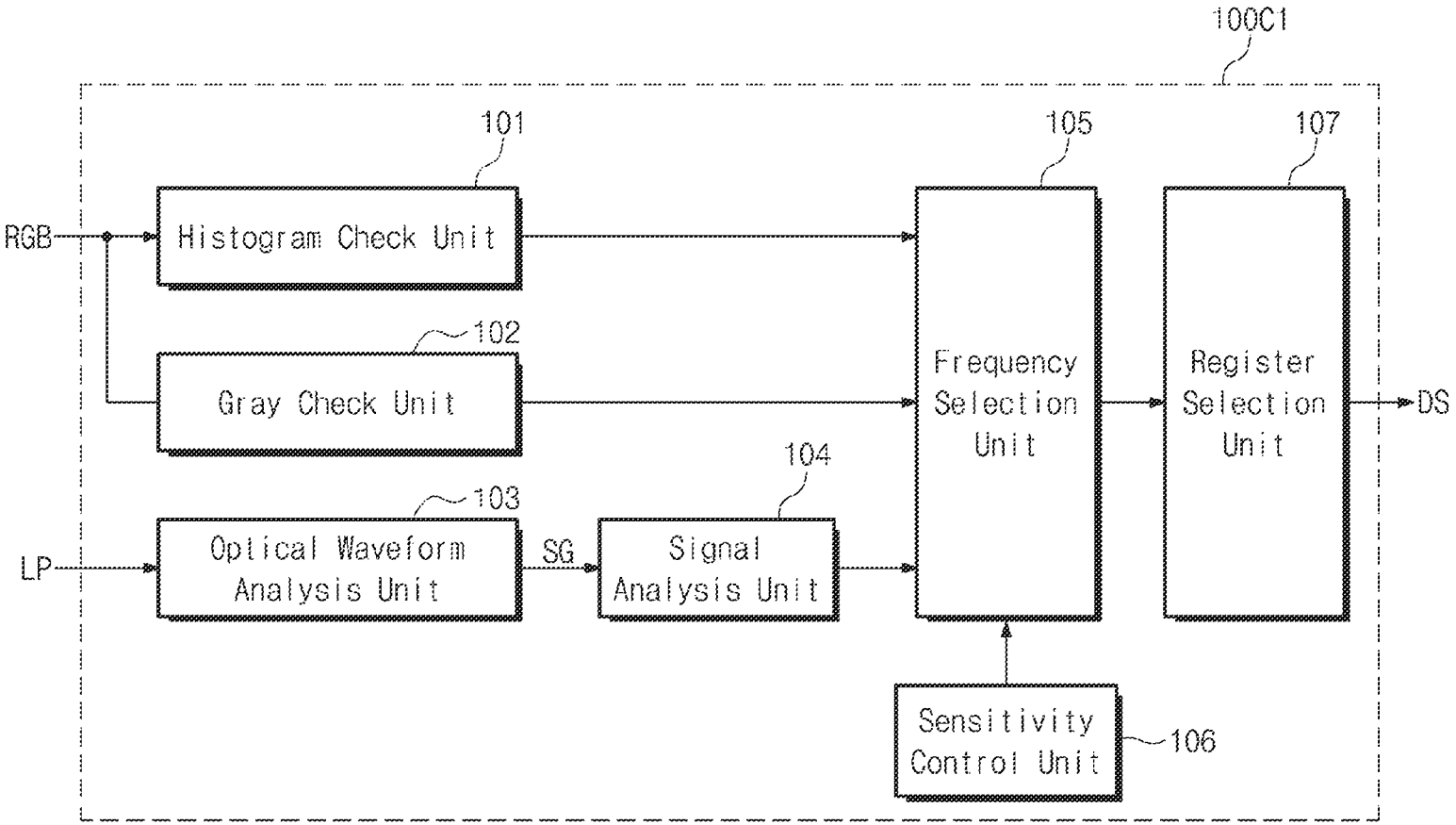
FIG. 6 is a block diagram illustrating a signal control circuit, according to an embodiment of the present disclosure.
Figure 7:
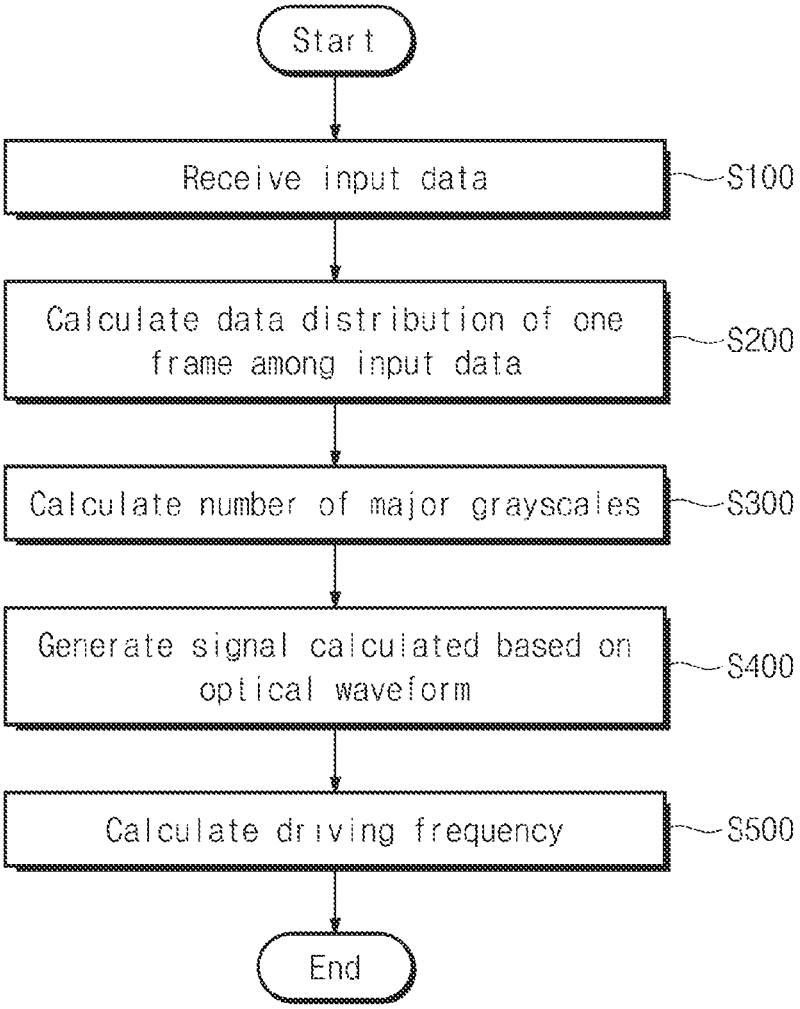
FIG. 7 is a flowchart illustrating the driving method of an electronic device according to an embodiment of the present disclosure.

FIG. 6 is a block diagram illustrating a signal control circuit according to an embodiment of the present disclosure. FIG. 7 is a flowchart illustrating the driving of an electronic device according to an embodiment of the present disclosure.

Referring to FIGS. 6 and 7, the signal control circuit 100C1 may receive the input data RGB from an external graphic processing unit (S100). The input data RGB may include data for a displayed image and a panel self refresh (PSR) signal. The PSR signal may be a signal for discriminating whether the corresponding image is a still image or a moving image. For example, when the PSR signal is a still image, the PSR signal may be a signal that causes the display panel 100 to display an image of an existing frame by itself.

The signal control circuit 100C1 may distinguish a type of image. The type of image may include, for example, a moving image, a still image, and a text screen.

The signal control circuit 100C1 may determine the type of image as a moving image based on the PSR signal. When the input data RGB is the moving image, that is, when input data RGB different from the input data RGB of the previous frame are input, the driving frequency of the display panel 100 may be controlled with the first driving frequency for driving the moving image. For example, the first driving frequency may be 120 Hz (hertz). However, this is only an example, and according to embodiments, the first driving frequency may be 60 Hz. The signal control circuit 100C1 may allow the display panel 100, the scan driving circuit 100C2, and the data driving circuit 100C3 to operate at the first driving frequency. Driving the display panel 100 at 120 Hz refers to displaying an image 120 times per second.

The signal control circuit 100C1 may determine the type of image as a still image based on the PSR signal. When the input data RGB is a still image, that is, when input data RGB identical to the input data RGB of the previous frame are input, the driving frequency of the display panel 100 may be controlled with a second driving frequency different from the first driving frequency for driving a still image. The second driving frequency may be less than the first driving frequency. For example, the second driving frequency may be about 30 Hz. However, this is only an example, and the second driving frequency may be a frequency of about 30 Hz or more and about 40 Hz or less according to embodiments. The signal control circuit 100C1 may allow the display panel 100, the scan driving circuit 100C2, and the data driving circuit 100C3 to operate at the second driving frequency. Driving the display panel 100 at 30 Hz refers to displaying an image 30 times per second.

The signal control circuit 100C1 may determine the type of image as a text screen based on the PSR signal. The signal control circuit 100C1 may determine the input data RGB as the text screen when the input data RGB, which are a still image, corresponds to a predetermined condition based on the PSR signal. When the input data RGB are the text screen, the driving frequency of the display panel 100 may be controlled with a third driving frequency different from the second driving frequency. The third driving frequency may be less than the second driving frequency. For example, the third driving frequency may be an ultra-low frequency of about 10 Hz or less. The signal control circuit 100C1 may allow the display panel 100, the scan driving circuit 100C2, and the data driving circuit 100C3 to operate at the third driving frequency. Driving the display panel 100 at about 10 Hz refers to displaying an image 10 times per second.

That is, according to embodiments, the display panel 100 may operate at a variable scan rate, for example, when the driving frequency of the electronic device 1000 (refer to FIG. 1) is lowered in a specific operating environment such as displaying a still image. As a result, power consumption of the electronic device 1000 (refer to FIG. 1) may be reduced.

Whether the image is a text screen may be calculated using a histogram check unit 101, a gray check unit 102, and an optical waveform analysis unit 103. This will be described in further detail below.

The signal control circuit 100C1 may include the histogram check unit 101, the gray check unit 102, the optical waveform analysis unit 103, a signal analysis unit 104, a frequency selection unit 105, a sensitivity control unit 106, and a register selection unit 107.

The histogram check unit 101 may divide data of one frame among the input data RGB into a plurality of regions based on a gray level. The histogram check unit 101 may calculate a data distribution based on the plurality of regions (S200).

The gray check unit 102 may calculate the number of major grayscales having a specific number of data or more among the input data RGB (S300).

The optical waveform analysis unit 103 may generate a signal SG calculated based on the optical waveform LP of the plurality of pixels PX (refer to FIG. 3) measured by the photodiode PD (refer to FIG. 3) (S400).

The signal analysis unit 104 may convert the signal SG into a frequency domain. The photodiode PD (refer to FIG. 3) may generate the optical waveform LP by measuring the brightness of light with respect to a time axis. The signal analysis unit 104 may convert the signal SG into a frequency domain to use the optical waveform LP to calculate the driving frequency of the display panel 100. The signal analysis unit 104 may include a function for Fourier transform. The Fourier transform may transform a time function or a spatial function into a time or spatial frequency component.

The frequency selection unit 105 may calculate the driving frequency of the display panel 100 based on, for example, the data distribution, the number of major grayscales, and the signal SG (S500).

Referring to a comparative example, unlike embodiments of the present disclosure, the driving frequency may be determined using data distribution and the number of major grayscales. In this case, the characteristics of the display panel 100 may not be reflected depending only on the brightness of an image and a histogram. The characteristics of the display panel 100 may refer to an optical waveform according to panel distribution or process conditions. Although it may be possible to further reduce visible flicker at a driving frequency based on the display panel 100, and to further reduce power consumption by decreasing the driving frequency, a case in which the display panel 100 is driven at a relatively high driving frequency may occur.

However, in contrast, according to embodiments of the present disclosure, the photodiode PD (refer to FIG. 3) may measure the optical waveform LP of the display panel 100. The optical waveform LP may include characteristics of the display panel 100. The frequency selection unit 105 may calculate the driving frequency of the display panel 100 based on the data distribution, the number of major grayscales, and the signal SG (S500) (refer to FIG. 7). The display panel 100 may be driven at a driving frequency capable of minimizing or reducing flicker and/or power consumption. Accordingly, embodiments of the present disclosure provide the electronic device 1000 (refer to FIG. 1) with reduced power consumption and increased display quality.

The sensitivity control unit 106 may include a temporal contrast sensitivity function. The temporal contrast sensitivity function may be stored in a memory. The sensitivity control unit 106 may convert the temporal contrast sensitivity into the frequency domain. The sensitivity control unit 106 may include a function for Fourier transform. The Fourier transform may transform a time function or a spatial function into a time or spatial frequency component. The frequency selection unit 105 may calculate the driving frequency based on a value received from the sensitivity control unit 106. Sensitivity contrast frequency converted to the frequency domain will be described in further detail below.

The register selection unit 107 may also select various set values of the display panel 100 according to the driving frequency selected by the frequency selection unit 105, and may allow the display panel 100 to be driven with corresponding register values. The register value may include an initial register value utilized when the display panel 100 is driven. The register selection unit 107 may output the data signal DS based on a corresponding register value. The display panel 100 may be driven based on the data signal DS.

Figure 8:
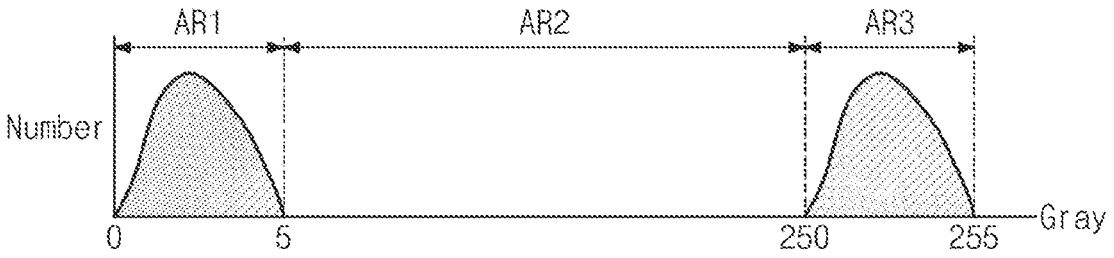
FIG. 8 is a diagram illustrating a histogram distribution of data, according to an embodiment of the present disclosure.

FIG. 8 is a diagram illustrating a histogram distribution of data, according to an embodiment of the present disclosure.

Referring to FIGS. 6 and 8, the input data RGB may be input to the histogram check unit 101. The histogram check unit 101 may divide data of one frame among the input data RGB into a plurality of regions AR1, AR2, and AR3 based on the grayscales. As a criterion for dividing the plurality of regions AR1, AR2, and AR3, 5 grayscales and 250 grayscales are used from 256 grayscales (0 to 255 grayscales). The middle grayscale region may include a wide grayscale range from 6 grayscales to 249 grayscales. However, this is only an example, and the numerical value may be changed according to embodiments of the present disclosure. The plurality of regions AR1, AR2, and AR3 may include a first region AR1, a second region AR2, and a third region AR3. The first region AR1 may be referred to as a low grayscale region, the second region AR2 may be referred to as a middle grayscale region, and the third region AR3 may be referred to as a high grayscale region.

The histogram check unit 101 may determine the number of data included in each of the plurality of regions AR1, AR2, and AR3. The histogram check unit 101 may check the histogram based on the ratio of data included in the first region AR1 and the third region AR3 based on the number of data. The histogram check unit 101 may determine the type of image based on the data ratio. The type of image may include a moving image, a still image, and a text screen.

The histogram check unit 101 may determine the type of image as a text screen when data is included in the first region AR1 and the third region AR3 by at least a predetermined ratio. For example, as illustrated in FIG. 8, when there is data distribution in the first region AR1 and the third region AR3, and there is no data distribution in the second region AR2, the histogram check unit 101 may determine the type of image as the text screen.

Figure 9:
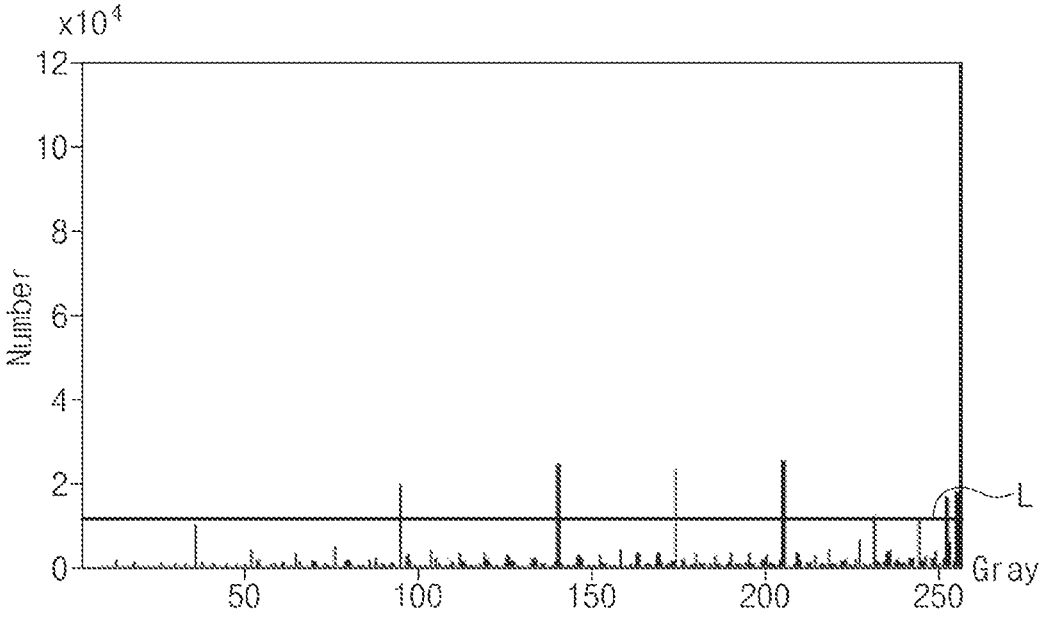
FIG. 9 is a diagram illustrating a distribution of gray data, according to an embodiment of the present disclosure.

FIG. 9 is a diagram illustrating a distribution of gray data, according to an embodiment of the present disclosure.

Refer to FIGS. 6 and 9, in FIG. 9, the number of data corresponding to one frame of data for each gray scale is illustrated as a bar graph.

The gray check unit 102 may calculate the number of major grayscales having a specific number of data or more among the input data RGB (S300).

A horizontal line L illustrated in FIG. 9 is a line indicating a specific number, which is a criterion for determining whether a major grayscale is present, and in FIG. 9, about 0.5% of the total data of one frame is illustrated as an example. That is, in an embodiment according to FIG. 9, a grayscale corresponding to a specific number e.g., (0.5% of total data) or more may be regarded as the major grayscale, and the number may be determined.

The gray check unit 102 may determine the type of image based on the number of major grayscales. When the number of major grayscales identified as described above is less than or equal to a specific number, the gray check unit 102 may determine the type of image as a text screen. FIG. 9 illustrates that the number of major grayscales serving as a reference is 10, and the number of major grayscales greater than or equal to a specific number is 8. In this case, the gray check unit 102 may determine the type of image as a text screen.

FIGS. 10A, 11A, 12A, and 13A illustrate optical waveforms according to an embodiment of the present disclosure. FIGS. 10B, 11B, 12B, and 13B are simulations illustrating changes in the visibility of flicker corresponding to optical waveforms according to an embodiment of the present disclosure.

To quantitatively evaluate the flicker level of the electronic device 1000 (refer to FIG. 1), it may be measured by the JEITA Method Flicker measurement method. The JEITA Method Flicker may be a quantitative value of flicker defined by the Japan Electronic Information Technology Industry Association.

Figure 10A:
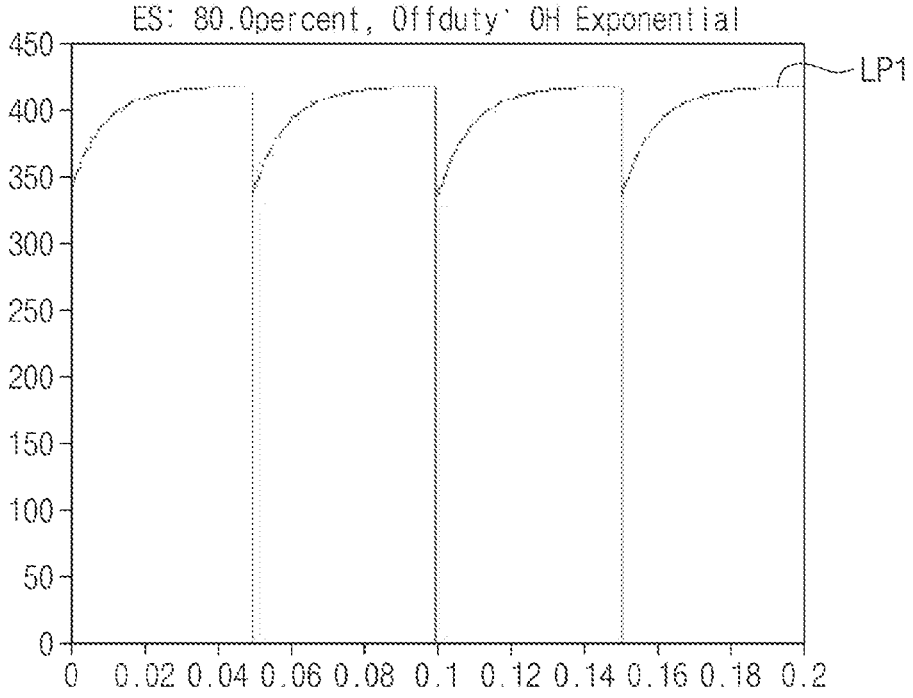
FIGS. 10A, 11A, 12A, and 13A are diagrams illustrating optical waveforms, according to an embodiment of the present disclosure.
Figure 10B:
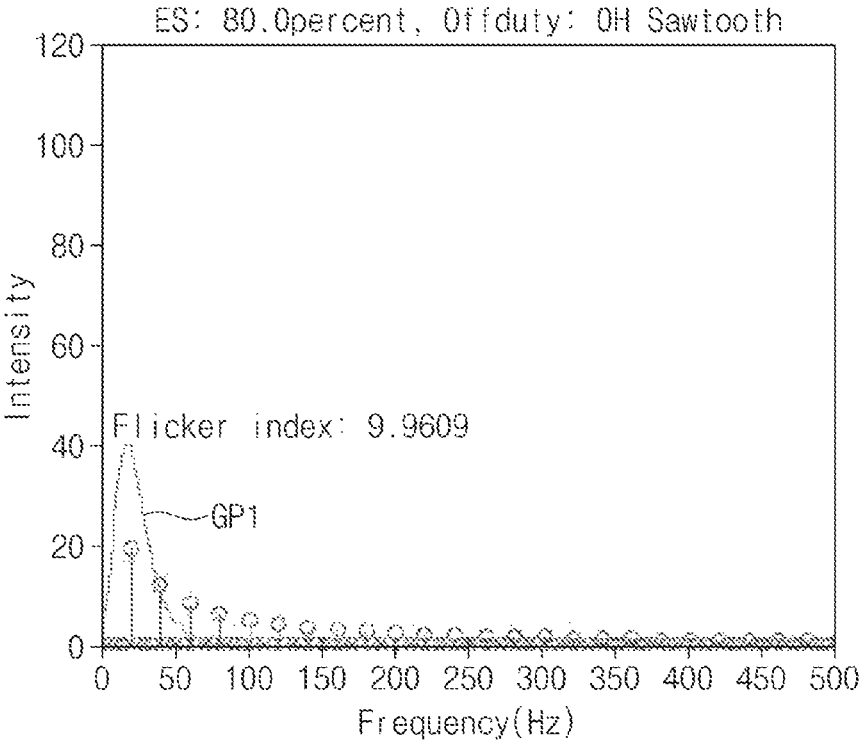
FIGS. 10B, 11B, 12B, and 13B are simulations illustrating a change in visibility of flicker corresponding to an optical waveform, according to an embodiment of the present disclosure.

Referring to FIGS. 6, 10A, and 10B, the photodiode PD (refer to FIG. 3) may measure a first optical waveform LP1 of the display panel 100 (refer to FIG. 3). A first graph GP1 may be calculated by measuring flicker based on the first optical waveform LP1. A peak value of a flicker index of the first graph GP1 may be about 9.961. When the JEITA value is calculated based on the flicker index, it may be about −52.28.

Referring to a comparative example, unlike embodiments of the present disclosure, when a driving frequency is selected using only the histogram and brightness of an image and the optical waveform LP of the display panel 100 (refer to FIG. 3) is not considered, power consumption may increase by operating at a relatively high driving frequency, although it may be possible to reduce the visible flicker by selecting a driving frequency according to the characteristics of the display panel 100 (refer to FIG. 3) or to set the drive frequency to be lower, as illustrated in FIGS. 10A and 10B.

However, in contrast, according to embodiments of the present disclosure, the photodiode PD (refer to FIG. 3) may measure the optical waveform LP of the display panel 100. The optical waveform analysis unit 103 may calculate the signal SG based on the optical waveform LP. The frequency selection unit 105 may calculate the driving frequency of the display panel 100 (refer to FIG. 3) based on the data distribution, the number of major grayscales, and the signal SG. That is, a different degree of visibility of the flicker may be considered according to the optical waveform LP through the signal SG. The display panel 100 (refer to FIG. 3) may be driven at a driving frequency capable of minimizing or reducing flicker and power consumption. Accordingly, embodiments of the present disclosure provide the electronic device 1000 (refer to FIG. 1) with reduced power consumption and reduced flicker that is recognizable to the user.

Figure 11A:
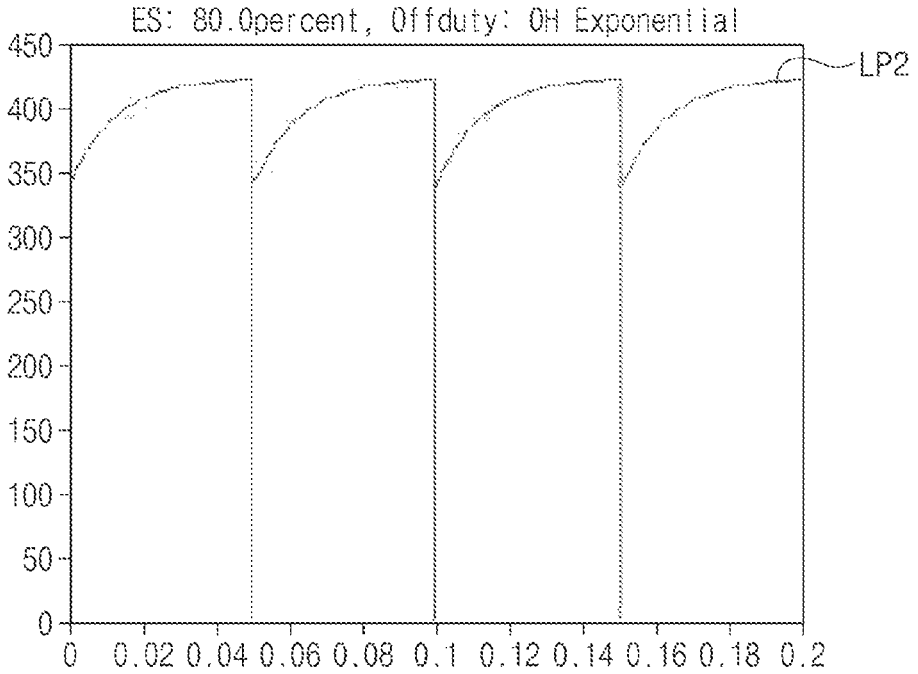
Figure 11B:
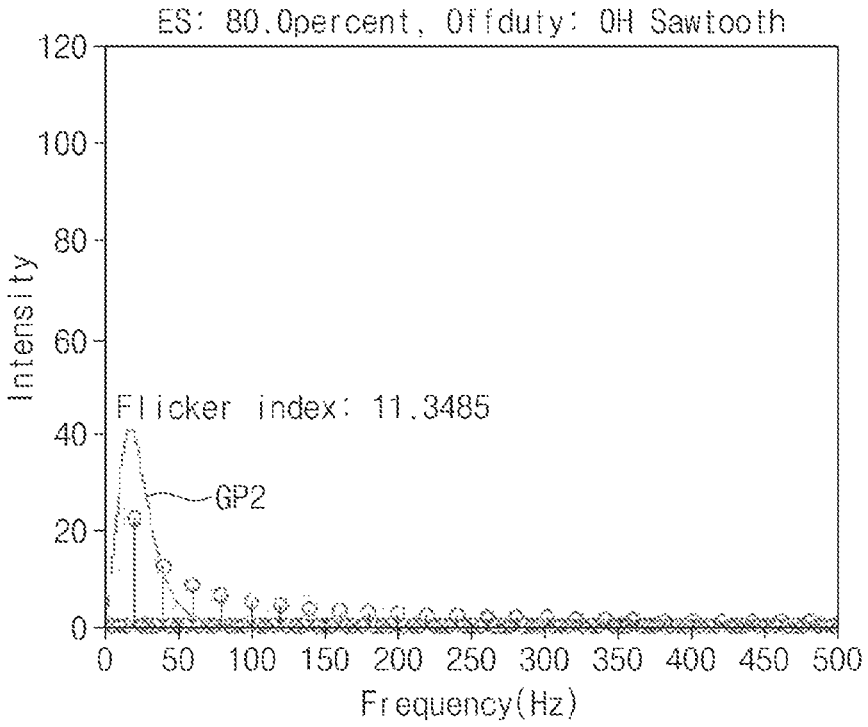

Referring to FIGS. 6, 11A, and 11B, the photodiode PD (refer to FIG. 3) may measure a second optical waveform LP2 of the display panel 100 (refer to FIG. 3). In this case, the display panel 100 (refer to FIG. 3) measured in FIG. 11A may have different conditions from the display panel 100 (refer to FIG. 3) measured in FIG. 10A. A second graph GP2 may be calculated by measuring flicker based on the second optical waveform LP2. The peak value of the flicker index of the second graph GP2 may be about 11.348. When the JEITA value is calculated based on the flicker index, it may be about −51.13.

Figure 12A:
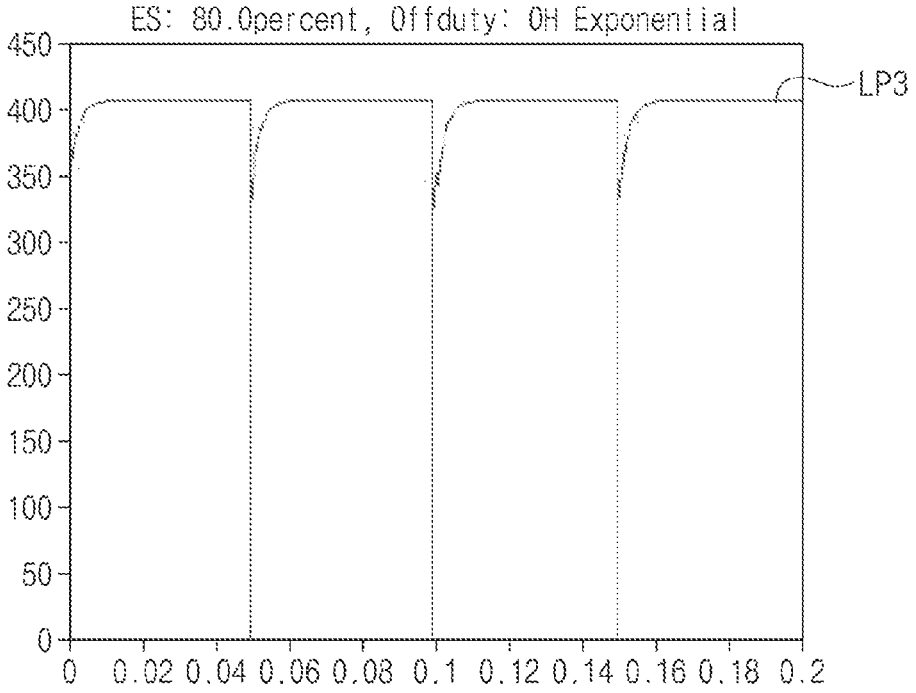
Figure 12B:
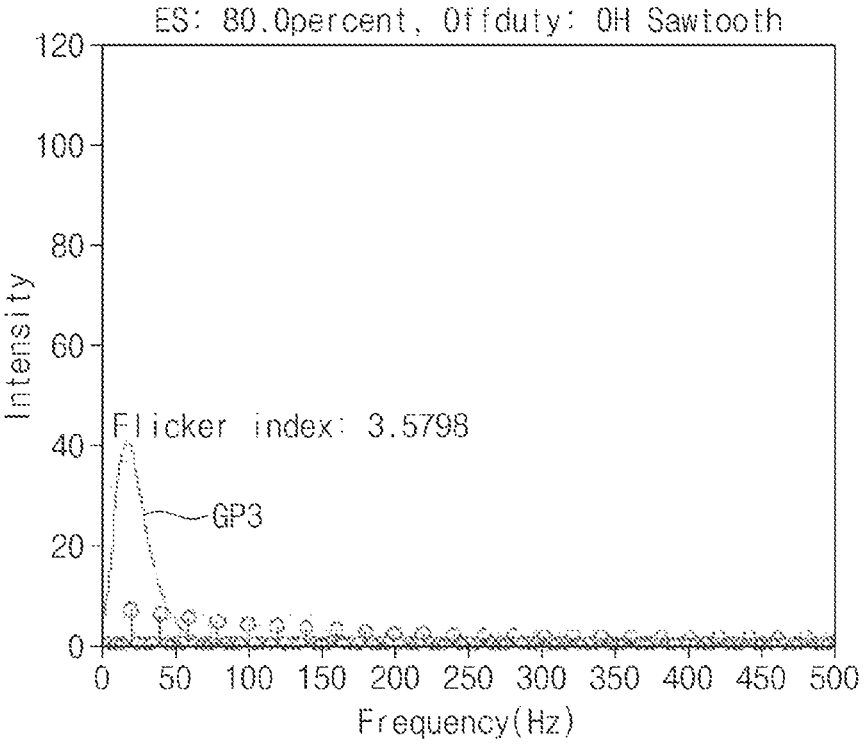

Referring to FIGS. 6, 12A, and 12B, the photodiode PD (refer to FIG. 3) may measure a third optical waveform LP3 of the display panel 100 (refer to FIG. 3). A third graph GP3 may be calculated by measuring flicker based on the third optical waveform LP3. The peak value of the flicker index of the third graph GP3 may be about 3.579. When the JEITA value is calculated based on the flicker index, it may be about −58.15.

Figure 13A:
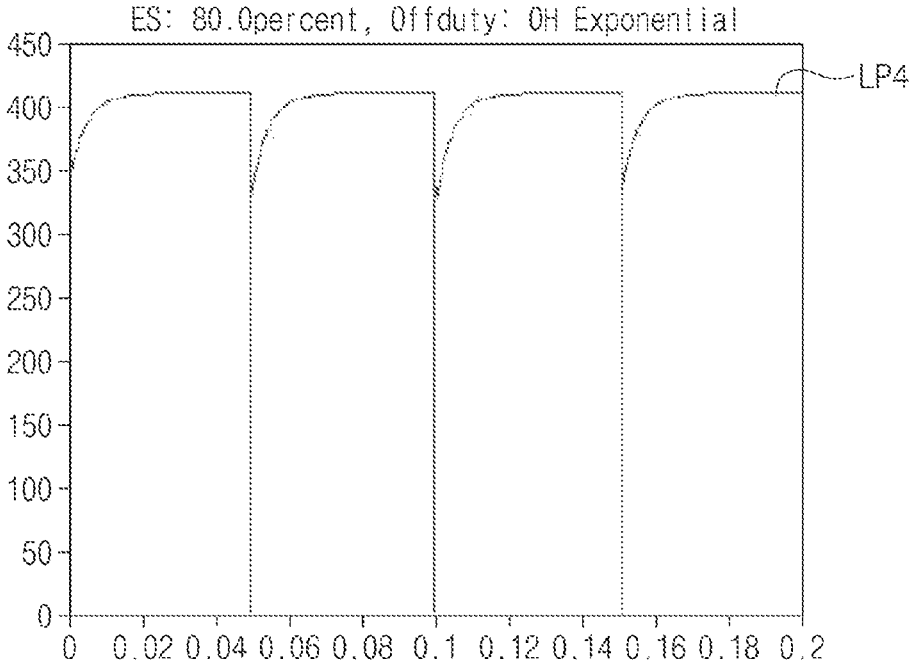
Figure 13B:
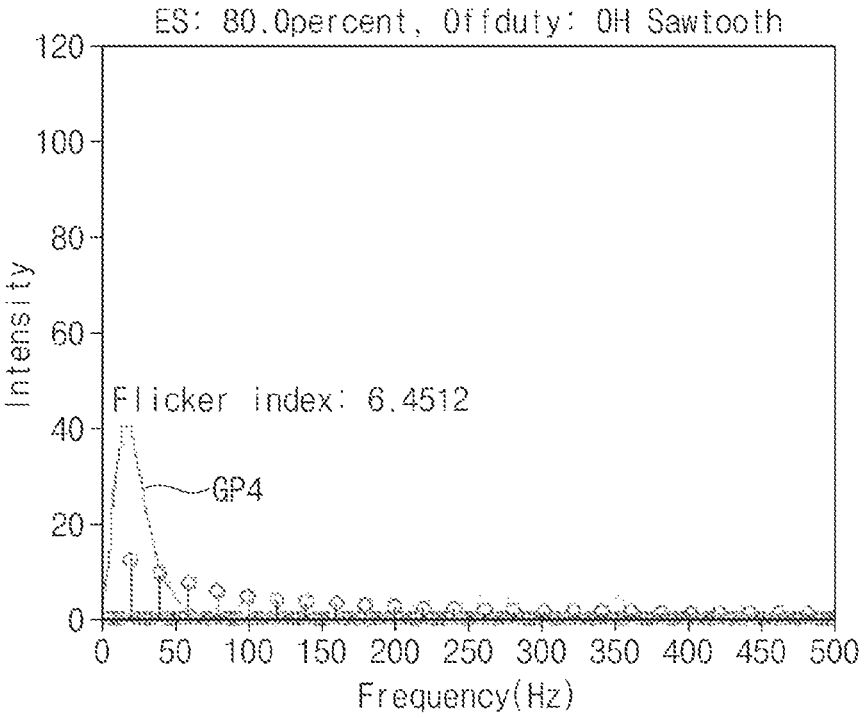

Referring to FIGS. 6, 13A, and 13B, the photodiode PD (refer to FIG. 3) may measure a fourth optical waveform LP4 of the display panel 100 (refer to FIG. 3). A fourth graph GP4 may be calculated by measuring flicker based on the fourth optical waveform LP4. The peak value of the flicker index of the fourth graph GP4 may be about 6.45. When the JEITA value is calculated based on the flicker index, it may be about −56.12.

The shape of the optical waveform LP may be changed according to, for example, the type of the display panel 100, process conditions, and/or driving grayscales. The type of the transistor 100PC (refer to FIG. 5) of the display panel 100 (refer to FIG. 3) may include, for example, a hybrid oxide and polycrystalline silicon transistor, a low-temperature polycrystalline oxide transistor, an oxide transistor, etc. The driving grayscale may include, for example, a low grayscale, a middle grayscale, and a high grayscale. Depending on the shape of the optical waveform LP, a difference in the visibility characteristics of the flicker may occur.

According to embodiments of the present disclosure, the photodiode PD (refer to FIG. 3) may measure the optical waveforms LP1, LP2, LP3, and LP4 of the display panel 100 (refer to FIG. 3). The optical waveforms LP1, LP2, LP3, and LP4 may be different according to the display panel 100. The optical waveforms LP1, LP2, LP3, and LP4 may include characteristics of the display panel 100 (refer to FIG. 3). The frequency selection unit 105 may calculate the driving frequency of the display panel 100 based on the data distribution, the number of major grayscales, and the signal SG. That is, different degrees of visibility of the flicker may be considered according to the optical waveforms LP1, LP2, LP3, and LP4 through the signal SG. The display panel 100 (refer to FIG. 3) may be driven at a driving frequency capable of minimizing or reducing flicker and power consumption. Accordingly, embodiments of the present disclosure provide the electronic device 1000 (refer to FIG. 1) with reduced power consumption and increased display quality.

Figure 14A:
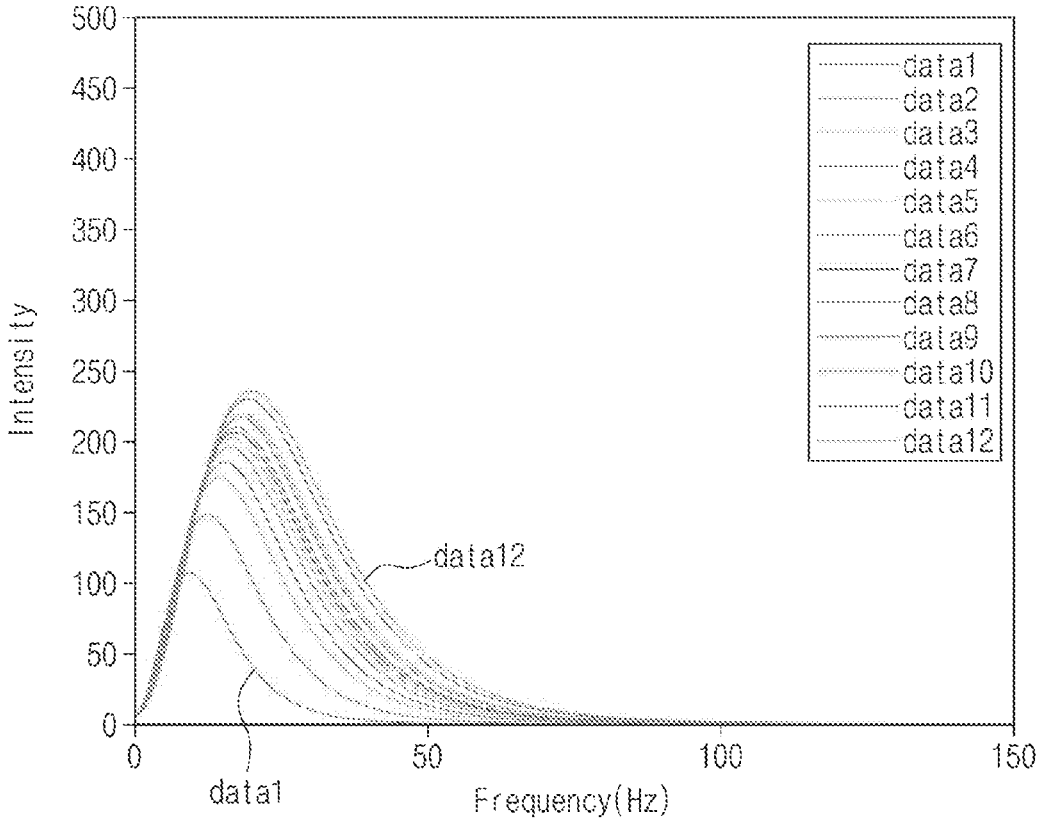
FIG. 14A is a diagram illustrating a sensitivity versus a frequency depending on a luminance, according to an embodiment of the present disclosure.
Figure 14B:
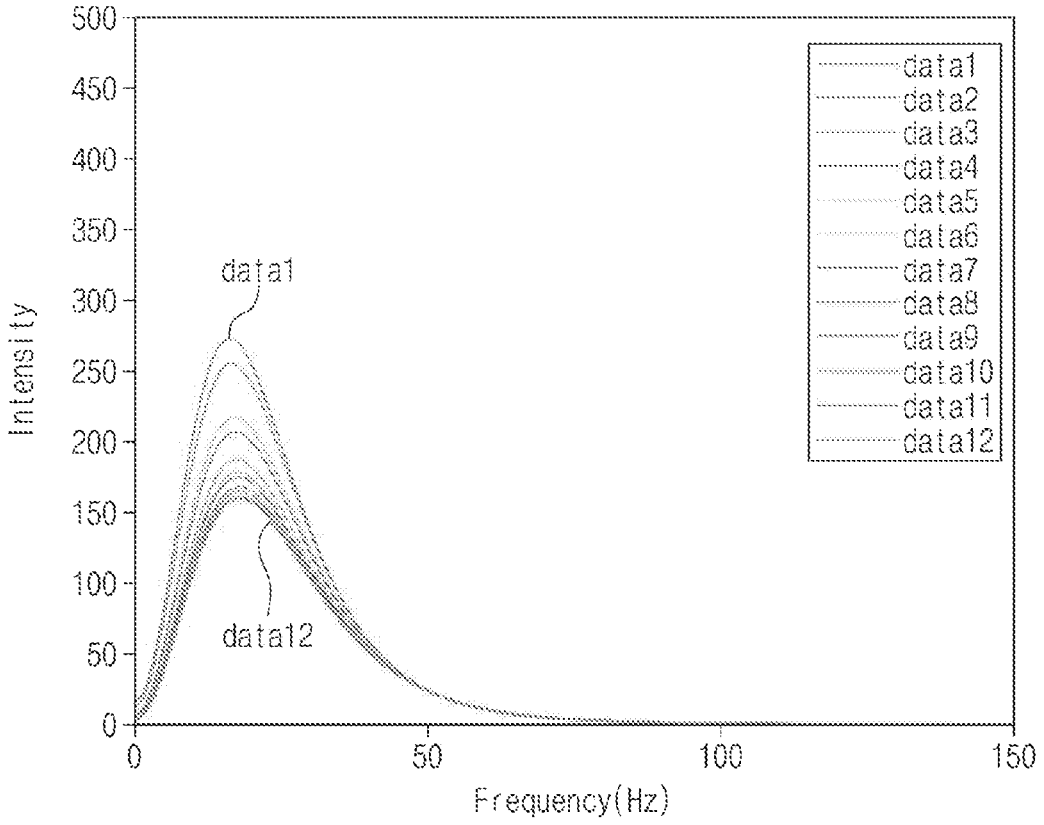
FIG. 14B is a diagram illustrating a sensitivity versus a frequency depending on a size of a display panel, according to an embodiment of the present disclosure.

FIG. 14A is a diagram illustrating a sensitivity versus a frequency depending on a luminance, according to an embodiment of the present disclosure. FIG. 14B is a diagram illustrating a sensitivity versus a frequency depending on a size of a display panel, according to an embodiment of the present disclosure.

Referring to FIGS. 3, 6, and 14A, a first graph data1 illustrates the sensitivity versus frequency of the display panel 100 having a luminance of about 1 nit. A second graph data2 illustrates the sensitivity versus frequency of the display panel 100 having a luminance of about 10 nits. A third graph data3 illustrates the sensitivity versus frequency of the display panel 100 having a luminance of about 50 nits. A fourth graph data4 illustrates the sensitivity versus frequency of the display panel 100 having a luminance of about 100 nits. A fifth graph data5 illustrates the sensitivity versus frequency of the display panel 100 having a luminance of about 200 nits. A sixth graph data6 illustrates the sensitivity versus frequency of the display panel 100 having a luminance of about 300 nits. A seventh graph data7 illustrates the sensitivity versus frequency of the display panel 100 having a luminance of about 400 nits. An eighth graph data8 illustrates the sensitivity versus frequency of the display panel 100 having a luminance of about 500 nits. A nineth graph data9 illustrates the sensitivity versus frequency of the display panel 100 having a luminance of about 800 nits. A tenth graph data 10 illustrates the sensitivity versus frequency of the display panel 100 having a luminance of about 1000 nits. An eleventh graph data11 illustrates the sensitivity versus frequency of the display panel 100 having a luminance of about 2000 nits. A twelfth graph data12 illustrates the sensitivity versus frequency of the display panel 100 having a luminance of about 3000 nits.

When the frequency is relatively low, an intensity value of the sensitivity may be relatively high. This may mean that the flicker is more likely to be recognized since the sensitivity for recognizing the flicker is high at a low frequency. The first to twelfth graphs data1 to data12 may be stored in the sensitivity control unit 106. The frequency selection unit 105 may select a driving frequency in consideration of sensitivity versus frequency based on the sensitivity control unit 106.

Referring to FIGS. 3, 6, and 14B, the first graph data1 illustrates the sensitivity versus frequency of the display panel 100 having a size of about 5 inches. The second graph data2 illustrates the sensitivity versus frequency of the display panel 100 having a size of about 7 inches. The third graph data3 illustrates the sensitivity versus frequency of the display panel 100 having a size of about 13 inches. The fourth graph data4 illustrates the sensitivity versus frequency of the display panel 100 having a size of about 15.6 inches. The fifth graph data5 illustrates the sensitivity versus frequency of the display panel 100 having a size of about 24 inches. The sixth graph data6 illustrates the sensitivity versus frequency of the display panel 100 having a size of about 31 inches. The seventh graph data7 illustrates the sensitivity versus frequency of the display panel 100 having a size of about 35 inches. The eighth graph data8 illustrates the sensitivity versus frequency of the display panel 100 having a size of about 47 inches. The nineth graph data9 illustrates the sensitivity versus frequency of the display panel 100 having a size of about 55 inches. The tenth graph data10 illustrates the sensitivity versus frequency of the display panel 100 having a size of about 65 inches. The eleventh graph data11 illustrates the sensitivity versus frequency of the display panel 100 having a size of about 75 inches. The twelfth graph data12 illustrates the sensitivity versus frequency of the display panel 100 having a size of about 85 inches.

When the frequency is relatively low, an intensity value of the sensitivity may be relatively high. This may mean that the flicker is more likely to be recognized because the sensitivity for recognizing the flicker is high at a low frequency. The first to twelfth graphs data1 to data12 may be stored in the sensitivity control unit 106. The frequency selection unit 105 may select a driving frequency in consideration of sensitivity versus frequency based on the sensitivity control unit 106.

According to embodiments of the present disclosure, the frequency selection unit 105 may calculate the driving frequency based on the flicker sensitivity received from the sensitivity control unit 106. That is, the frequency selection unit 105 may consider the degree of visibility of the flicker based on the sensitivity versus the frequency. The display panel 100 (refer to FIG. 3) may be driven at a driving frequency capable of minimizing or reducing flicker and power consumption. Accordingly, embodiments of the present disclosure provide the electronic device 1000 (refer to FIG. 1) with reduced power consumption and reduced flicker that is recognizable to the user.

Figure 15:
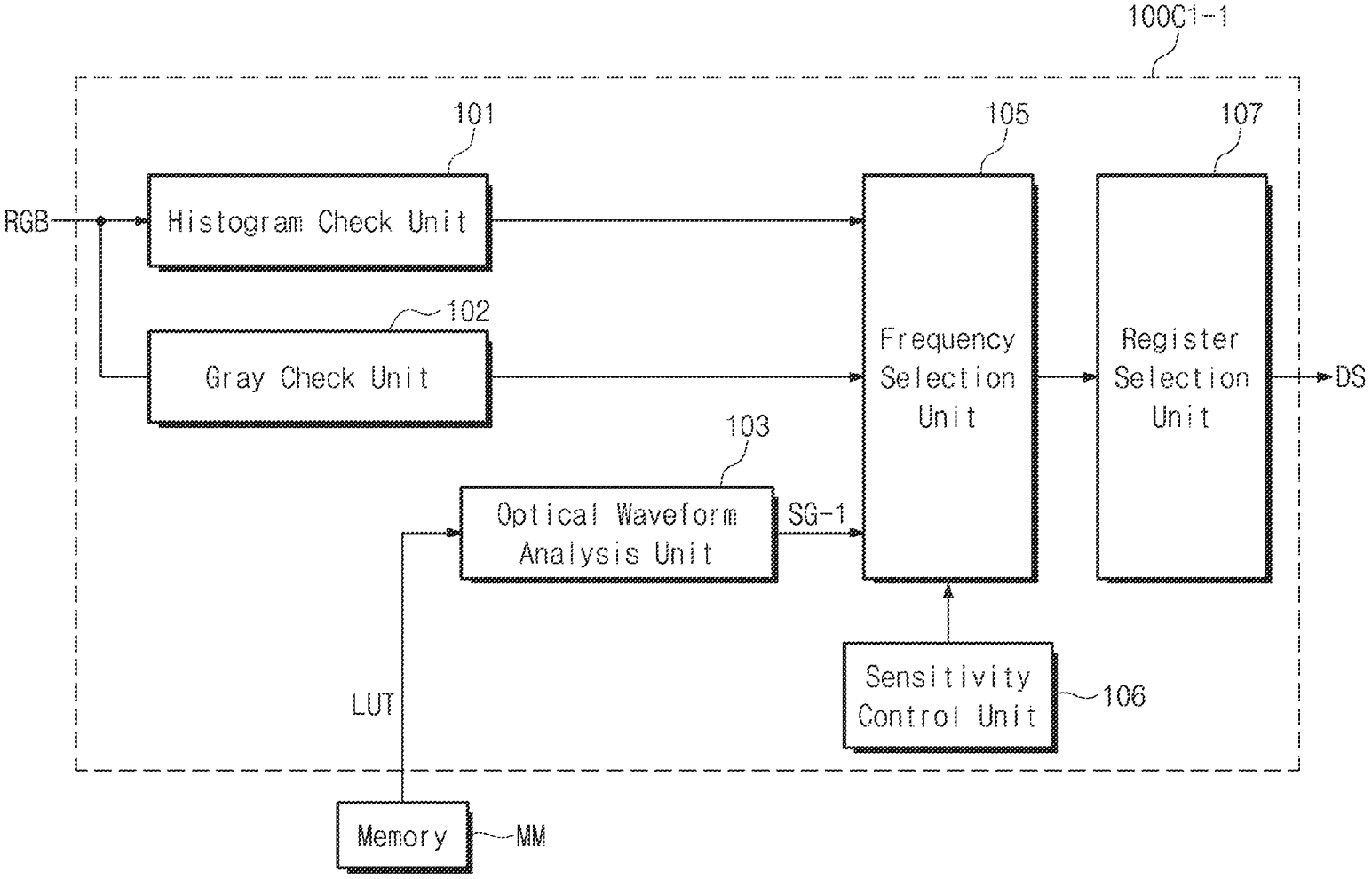
FIG. 15 is a block diagram illustrating a signal control circuit, according to an embodiment of the present disclosure.

FIG. 15 is a block diagram illustrating a signal control circuit, according to an embodiment of the present disclosure.

In the description of FIG. 15, for convenience of explanation, the same reference numerals are assigned to the same components described with reference to FIG. 6, and a further description of components and technical aspects previously described is omitted.

Referring to FIGS. 3 and 15, a signal control circuit 100C1-1 may receive information LUT on the optical waveform of the display panel 100 from an external memory MM. The information LUT on the optical waveform may be provided in the form of a lookup table. However, this is only an example, and the information LUT on the optical waveform according to embodiments of the present disclosure are not limited thereto. For example, the information LUT on the optical waveform may be provided as a map generated based on the optical waveform according to an embodiment.

The histogram check unit 101 may calculate a data distribution based on the plurality of regions.

The gray check unit 102 may calculate the number of major grayscales having a specific number of data or more among the input data RGB.

The optical waveform analysis unit 103 may generate a signal SG-1 based on the information LUT on the optical waveform.

The frequency selection unit 105 may calculate the driving frequency of the display panel 100 based on the data distribution, the number of major grayscales, and the signal SG-1.

Referring to a comparative example, unlike embodiments of the present disclosure, the driving frequency may be determined using data distribution and the number of major grayscales. In this case, the characteristics of the display panel 100 may not be reflected depending only on the brightness of an image and the histogram. The characteristics of the display panel 100 may refer to an optical waveform according to panel distribution or process conditions. Although it is possible to further reduce visible flicker by selecting a driving frequency based on the characteristics of the display panel 100, and to further reduce power consumption by decreasing the driving frequency, a case in which the display panel 100 is driven at a relatively high driving frequency may occur.

However, in contrast, according to embodiments of the present disclosure, the information LUT on the optical waveform may be stored in the memory MM. The information LUT on the optical waveform may be provided to the frequency selection unit 105. The information LUT on the optical waveform may include characteristics of the display panel 100. The frequency selection unit 105 may calculate the driving frequency of the display panel 100 based on the data distribution, the number of major grayscales, and the information LUT on the optical waveform. The display panel 100 may be driven at a driving frequency capable of minimizing or reducing flicker and/or power consumption. Accordingly, embodiments of the present disclosure provide the electronic device 1000 (refer to FIG. 1) with reduced power consumption and increased display quality.

According to the embodiments of the present disclosure as described above, the photodiode may measure an optical waveform of a display panel. The optical waveform may include characteristics of the display panel. A frequency selection unit may calculate a driving frequency of the display panel based on a signal calculated based on a histogram distribution of data, the number of major grayscales, and an optical waveform. The display panel may be driven at a driving frequency capable of minimizing a flicker and/or power consumption. Accordingly, it is possible to provide an electronic device with reduced power consumption and increased display quality.

As is traditional in the field of the present disclosure, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the invention. Further, the blocks, units and/or modules of the exemplary embodiments may be physically combined into more complex blocks, units and/or modules without departing from the scope of the disclosure.

While the present disclosure has been particularly shown and described with reference to embodiments thereof, it will be understood by those of ordinary skill in the art that various changes in form and detail may be made therein without departing from the spirit and scope of the present disclosure as defined by the following claims.

What is claimed is:

1. An electronic device, comprising:

a display panel comprising a plurality of scan lines, a plurality of data lines, and a plurality of pixels, and configured to display an image;

a data driving circuit connected to the plurality of data lines;

a scan driving circuit connected to the plurality of scan lines; and a signal control circuit configured to receive input data and control the display panel, the data driving circuit, and the scan driving circuit, wherein the signal control circuit comprises:

a histogram check unit configured to divide data of one frame among the input data into a plurality of regions based on a gray scale and calculate a distribution of the data of the one frame based on the plurality of regions;

a gray check unit configured to calculate a number of major grayscales having data of a specific number or more among the input data;

an optical waveform analysis unit configured to generate a signal calculated based on an optical waveform of the plurality of pixels; and a frequency selection unit configured to select a driving frequency of the display panel based on the distribution of the data of the one frame, the number of the major grayscales, and the signal.

2. The electronic device of claim 1, wherein the display panel further comprises a photodiode disposed adjacent to the plurality of pixels.

3. The electronic device of claim 2, wherein the optical waveform analysis unit calculates the signal based on the optical waveform, which is measured by the photodiode.

4. The electronic device of claim 2, wherein an active region and a peripheral region disposed adjacent to the active region are defined in the display panel, and wherein the photodiode is disposed in the peripheral region.

5. The electronic device of claim 2, wherein, when viewed in a plan view, the photodiode does not overlap the plurality of pixels.

6. The electronic device of claim 1, further comprising:

a memory comprising a lookup table comprising information of the optical waveform depending on the display panel, and wherein the optical waveform analysis unit generates the signal based on the lookup table.

7. The electronic device of claim 1, wherein the histogram check unit determines a type of the image based on the distribution of the data, and wherein the type of the image comprises a moving image, a still image, and a text screen.

8. The electronic device of claim 7, wherein the gray check unit determines the type of the image based on the number of the major grayscales.

9. The electronic device of claim 7, wherein the plurality of regions comprise a low grayscale region, a middle grayscale region, and a high grayscale region, and wherein the histogram check unit determines the type of the image as the text screen when the data are included in the low grayscale region and the high grayscale region by at least a predetermined specific ratio.

10. The electronic device of claim 1, wherein the signal control circuit further includes a signal analysis unit configured to convert the signal into a frequency domain.

11. The electronic device of claim 1, wherein the signal control circuit further comprises:

a sensitivity control unit comprising a time-to-sensitivity function, wherein the frequency selection unit calculates the driving frequency based on the time-to-sensitivity function.

12. The electronic device of claim 1, wherein the signal control circuit further comprises:

a register selection unit configured to select a register value depending on the selected driving frequency and output a data signal based on the register value, wherein the display panel is driven based on the data signal.

13. A method of driving an electronic device, the method comprising:

receiving input data by a signal control circuit that controls a driving frequency of a display panel;

dividing data of one frame among the input data into a plurality of regions based on a gray scale and calculating a distribution of the data of the one frame based on the plurality of regions;

calculating a number of major grayscales having data of a specific number or more among the input data;

generating a signal calculated based on an optical waveform of the display panel; and calculating the driving frequency based on the distribution of the data of the one frame, the number of the major grayscales, and the signal.

14. The method of claim 13, wherein the display panel comprises a plurality of pixels and a photodiode disposed adjacent to the plurality of pixels, and wherein generating the signal comprises receiving the optical waveform from the photodiode.

15. The method of claim 13, wherein the signal is generated based on a lookup table comprising information of the optical waveform.

16. The method of claim 13, wherein the display panel displays an image, and wherein calculating the driving frequency based on the distribution of the data of the one frame comprises determining a type of the image based on the distribution.

17. The method of claim 16, wherein calculating the number of major grayscales comprises determining the type of the image based on the number.

18. The method of claim 13, further comprising:

converting the signal into a frequency domain.

19. The method of claim 13, wherein calculating the driving frequency comprises:

receiving a time-to-sensitivity function; and calculating the driving frequency based on the time-to-sensitivity function.

20. The method of claim 13, further comprising:

selecting a register value depending on the driving frequency; and outputting a data signal based on the register value.

* * * * *